US006090514A

United States Patent [19]

Kakui et al.

[11] Patent Number: 6,090,514

[45] Date of Patent: Jul. 18, 2000

[54] ELECTROPHOTOGRAPHIC PHOTORECEPTOR

[75] Inventors: Mikio Kakui, Nara; Hirofumi Kawaguchi, Osaka; Akihiko Kawahara, Nara; Kazunari Hamasaki, Osaka; Yoshio Inagaki, Osaka; Ayako Yashima, Osaka, all of Japan

[73] Assignee: Mita Industrial Co., Ltd., Osaka, Japan

[21] Appl. No.: 09/367,897

[22] PCT Filed: Feb. 25, 1998

[86] PCT No.: PCT/JP98/00787

§ 371 Date: Aug. 20, 1999

§ 102(e) Date: Aug. 20, 1999

[87] PCT Pub. No.: WO98/38551

PCT Pub. Date: Sep. 3, 1998

[30] Foreign Application Priority Data

Feb. 26, 1997 [JP] Japan ..... 9-042444

[51] Int. Cl.[7] ..... G03G 5/06

[52] U.S. Cl. ..... 430/83

[58] Field of Search ..... 430/83

[56] References Cited

U.S. PATENT DOCUMENTS 5,932,383 8/1999 Nakata et al. ..... 430/83

FOREIGN PATENT DOCUMENTS 5-150482 6/1993 Japan .
5-150491 6/1993 Japan .
6-130694 5/1994 Japan .
7-244389 9/1995 Japan .
7-325414 12/1995 Japan .

*Primary Examiner*—Roland Martin
*Attorney, Agent, or Firm*—Smith, Gambrell & Russell, LLP

[57] ABSTRACT

The present invention provides an electrophotosensitive material comprising a conductive substrate and a single photosensitive layer containing a stilbene derivative (hole transferring material) represented by the general formula (1):

(1)

(wherein $R^1$, $R^2$, $R^5$ and $R^6$ are the same or different and represent an alkyl group, an alkoxy group, an aryl group, an aralkyl group or a halogen atom; m, n, p and q are the same or different and represent an integer of 0 to 3, with the proviso that m and n represent a different integer when substituents represented by $R^1$ and $R^2$ are the same and that p and q represent a different integer when substituents represented by $R^5$ and $R^6$ are the same; and $R^3$ and $R^4$ are the same or different and represent a hydrogen atom or an alkyl group) and an electron transferring material, which is provided on the conductive substrate. This photosensitive material has high sensitivity and can be applied to any of positive and negative charging types with a single construction, and is also superior in optical characteristics.

3 Claims, 12 Drawing Sheets

ELECTROPHOTOGRAPHIC PHOTORECEPTOR

TECHNICAL FIELD

The present invention relates to an electrophotosensitive material which is used in image forming devices such as electrostatic copying machine, facsimile, laser beam printer and the like.

BACKGROUND ART

In the above image forming devices, various organic photosensitive materials having a sensitivity at a wavelength range of a light source used in said devices have been used. Recently, the organic photosensitive material has widely been used because of easy production in comparison with a conventional inorganic photosensitive material, various selective photosensitive materials (e.g. electric charge transferring material, electric charge generating material, binding resin, etc.) and high functional design freedom.

Examples of the organic photosensitive material include a single-layer type photosensitive material wherein an electric charge transferring material and an electric charge generating material are dispersed in the same photosensitive layer, and a multi-layer type photosensitive material comprising an electric charge generating layer containing an electric charge generating material and an electric charge transferring layer containing an electric charge transferring material, which are mutually laminated.

Japanese Patent Kokai Publication No. 7-244389 discloses a multi-layer type electrophotosensitive material containing a stilbene derivative represented by the general formula (6):

electric charge generating layer is formed thereon. Therefore, it becomes necessary to provide a protective on an outer-most layer, thereby to cause deterioration of optical characteristics of the photosensitive material. Therefore, there has hitherto been used a construction, wherein the electric charge transferring layer is formed on the outer-most layer, very often.

Regarding the electrophotosensitive material disclosed in the above publication, as described above, the above stilbene derivative (6) is used as the electric charge transferring material to be contained in the electric charge transferring material in the construction wherein the electric charge transferring layer is provided on the outer-most layer.

However, since this stilbene derivative (6) is a hole transferring material, the charging type of the photosensitive material becomes a negative charging type. As a result, it becomes necessary to use negative-polar corona discharging, which causes generation of a large amount of ozone, when the photosensitive material is charged, thereby causing such a problem that deterioration of the photosensitive material is promoted by ozone generated on charging and a bad influence is exerted on the environment.

There was also a problem that the photosensitivity of the resulting multi-layer type photosensitive material has never reached a level suited for practical use because charge transfer of the above stilbene derivative (6) is not sufficiently large.

DISCLOSURE OF THE INVENTION

It is a main object of the present invention to solve the above problems, thereby to provide a high-sensitivity electrophotosensitive material.

(6)

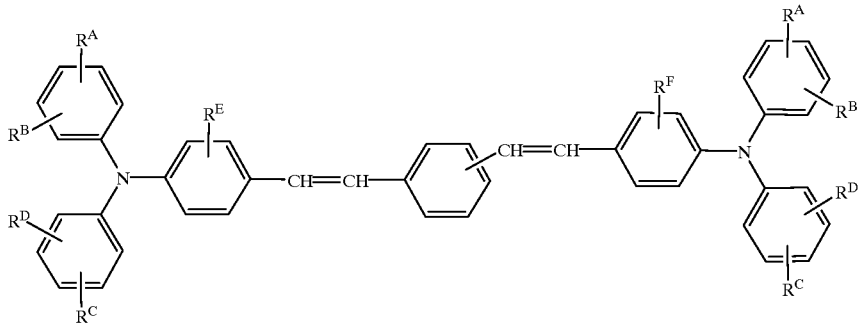

(wherein $R^A$, $R^B$, $R^C$ and $R^D$ represent a hydrogen atom, an alkyl group which may have a substituent, an aryl or alkyl group which may have a substituent, or an alkoxy group; and $R^E$ and $R^F$ represents a hydrogen atom, a halogen atom, an alkyl group, an alkoxy group or an aryl group) as a hole transferring material in a sensitive layer.

In the case of the multi-layer type photosensitive material, it is possible to select a positive or negative charging type according to the laminating order of an electric charge generating layer and an electric charge transferring layer as well as kind of an electric charge transferring material to be contained in the electric charge transferring layer. However, since a film thickness of the electric charge generating layer is smaller than that of the electric charge transferring layer, the strength of the surface of the photosensitive material becomes insufficient when the electric charge transferring layer is formed on a conductive substrate and then the In order to solve the above problems, the present inventors have studied intensively to find out a suitable compound as an electric charge transferring material used in such a photosensitive material, using a single-layer type photosensitive material as the construction of the electrophotosensitive material. As a result, they have found such a new fact that the above problems can be solved to obtain a high-sensitivity electrophotosensitive material when the electrophotosensitive material comprises a conductive substrate and a single photosensitive layer containing a hole transferring material and an electron transferring material, which is provided on the conductive substrate, wherein the hole transferring material is a stilbene derivative represented by the general formula (1):

(1)

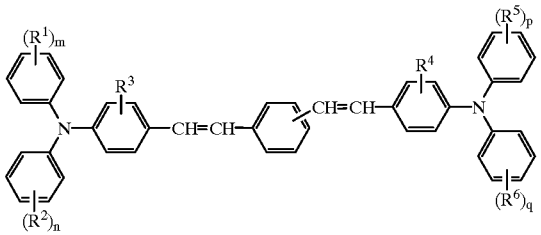

(wherein $R^1$, $R^2$, $R^5$ and $R^6$ are the same or different and represent an alkyl group, an alkoxy group, an aryl group, an aralkyl group or a halogen atom; m, n, p and q are the same or different and represent an integer of 0 to 3, with the proviso that m and n represent a different integer when substituents represented by $R^1$ and $R^2$ are the same and that p and q represent a different integer when substituents represented by $R^5$ and $R^6$ are the same; and $R^3$ and $R^4$ are the same or different and represent a hydrogen atom or an alkyl group). Thus, the present invention has been completed.

The electrophotosensitive material of the present invention can be applied to any of positive and negative charging types with a single construction because it is a single-layer type photosensitive material comprising a single photosensitive layer on a conductive substrate. The electrophotosensitive material has a simple layer construction and is superior in productivity, thereby making it possible to inhibit formation of film defects in the case of forming layers. Furthermore, it can exert excellent optical characteristics because of less interface between layers.

Regarding the stilbene derivative used as the hole transferring material in the electrophotosensitive material of the present invention, as shown in the general formula (1), diphenylamino groups at the end of the molecule are unsymmetrical. That is, two benzene rings of the diphenylamino group have different substituents or the number of the substituents is different. Due to such a constructional feature, the above stilbene derivative exhibits high charge transfer. Accordingly, a high-sensitive electrophotosensitive material can be obtained by containing this hole transferring material in a photosensitive layer, together with an electron transferring material.

When using at least one selected from the group consisting of diphenoquinone derivative represented by the general formula (2):

(2)

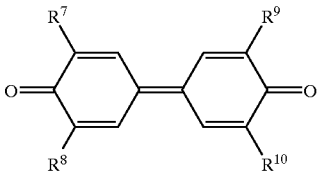

[wherein $R^7$, $R^8$, $R^9$ and $R^{10}$ are the same or different and represent a hydrogen atom, an alkyl group, an alkoxy group, an aryl group, an aralkyl group, a cycloalkyl group or an amino group, with the proviso that at least two substituents of $R^7$, $R^8$, $R^9$ and $R^{10}$ are the same and are groups other than a hydrogen atom], naphthoquinone derivative represented by the general formula (3):

(3)

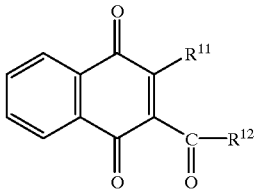

[wherein $R^{11}$ represents an alkyl group which may have a substituent, or an aryl group which may have a substituent; and $R^{12}$ represents an alkyl group which may have a substituent, an aryl group which may have a substituent, or a group:

$$-O-R^{12a}$$

(in which $R^{12a}$ represents an alkyl group which may have a substituent, or an aryl group which may have a substituent)], diazanaphtho[2,3-b]fluorene derivative represented by the general formula (4):

(4)

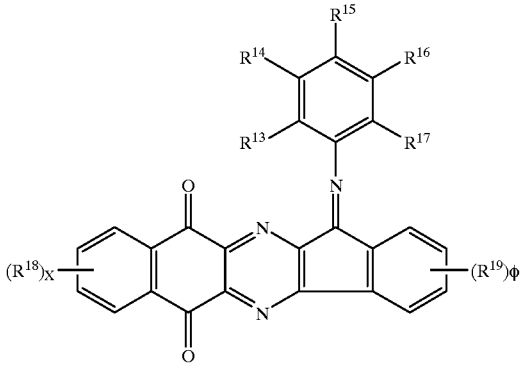

[wherein $R^{13}$, $R^{14}$, $R^{15}$, $R^{16}$, $R^{17}$, $R^{18}$ and $R^{19}$ are the same or different and represent an alkyl group, an aryl group, an aralkyl group, an alkoxy group, a halogen atom or a halogenated alkyl group; and $\chi$ and $\phi$ are the same or different and represent an integer of 0 to 4] and diazanaphtho[2,3-b] fluorene derivative represented by the general formula (5):

(5)

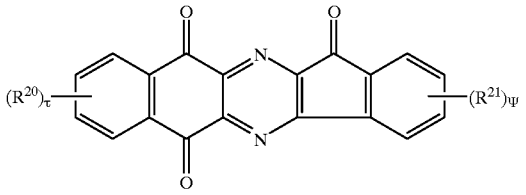

[wherein $R^{20}$ and $R^{21}$ are the same or different and represent an alkyl group, an aryl group, an alkoxy group, a halogen atom or a halogenated alkyl group; and $\tau$ and $\psi$ are the same or different and represent an integer of 0 to 4] as the electron transferring material in the electrophotosensitive material, there is not a fear that a charge transfer complex with the stilbene derivative (1) as the hole transferring material is formed. Accordingly, the electron transferring materials (2) to (5) described above are suitable for using in combination with the stilbene derivative (1).

BEST MODE FOR CARRYING OUT THE INVENTION

Figure 1:
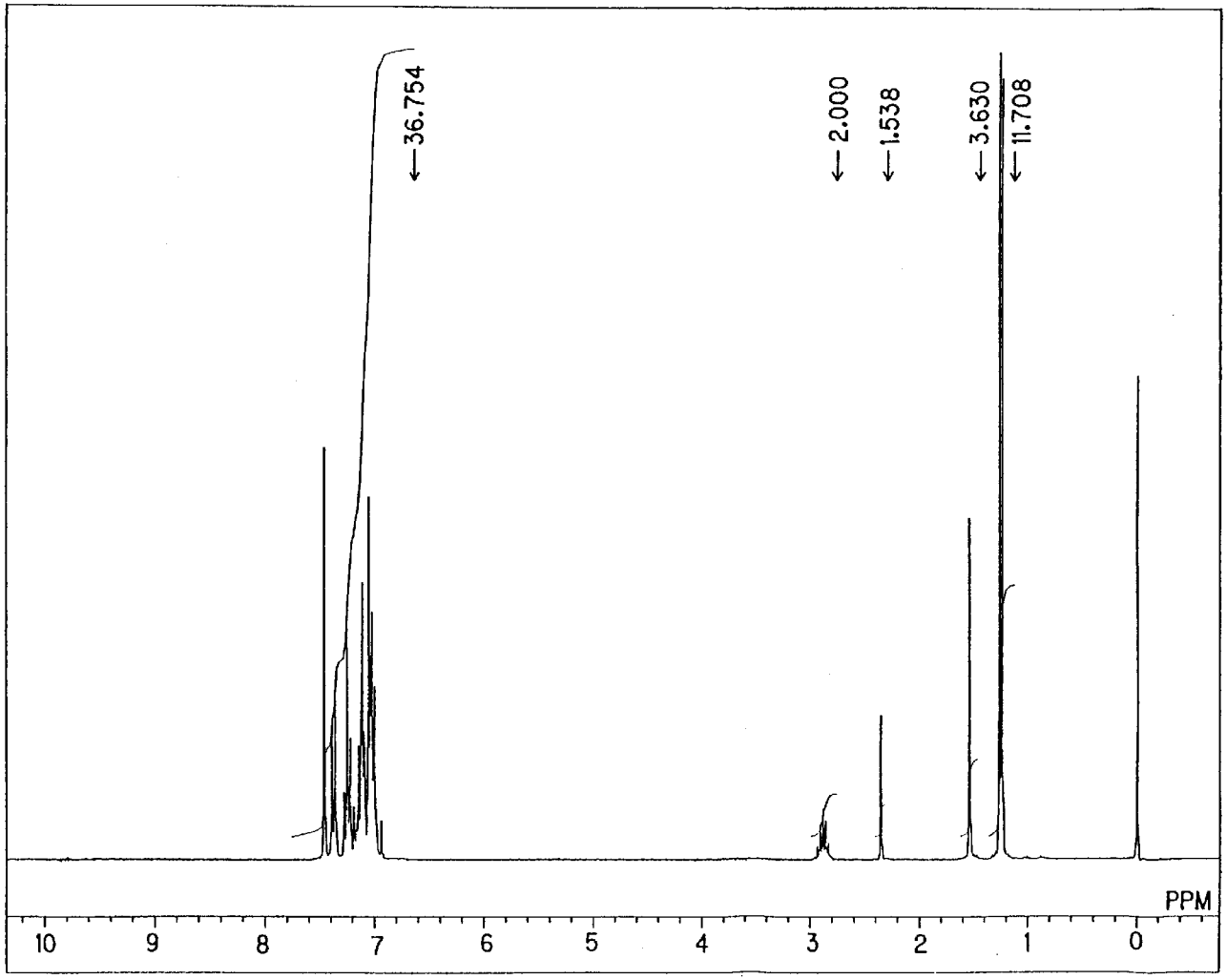
FIG. 1 is a graph illustrating a $^1$H-NMR spectrum of the stilbene derivative (11-9).

First, the stilbene derivative (1) used in the electrophotosensitive material of the present invention will be described in detail.

In the above general formula (1), examples of the alkyl group corresponding to $R^1$, $R^2$, $R^5$ and $R^6$ include groups having 1 to 6 carbon atoms, such as methyl, ethyl, n-propyl, isopropyl, n-butyl, isobutyl, s-butyl, t-butyl, n-pentyl, n-hexyl and the like. Examples of the alkoxy group include groups having 1 to 6 carbon atoms, such as methoxy, ethoxy, n-propoxy, isopropoxy, t-butoxy, n-pentyloxy, n-hexyloxy and the like. Examples of the aryl group include phenyl, naphthyl, anthryl, phenanthryl, fluorenyl, biphenylyl, o-terphenyl and the like. Examples of the aralkyl group include benzyl, phenethyl, benzhydryl, trityl and the like. Examples of the halogen atom include fluorine, chlorine, bromine, iodine and the like.

When the numerals m, n, p and q each representating the number of the above substituents $R^1$, $R^2$, $R^5$ and $R^6$ is not less than 2, different groups may be substituted on the same benzene ring. That is, when the numeral m representating the number of the substituent $R^1$ is 2, different groups (e.g. methyl group and ethyl group, methyl group and ethoxy group, etc.) may be substituted on the same benzene ring.

In the general formula (1), alkyl groups having 1 to 3 carbon atoms, which correspond to $R^3$ and $R^4$, are those wherein butyl, pentyl and hexyl are removed from the above alkyl groups having 1 to 6 carbon atoms.

The stilbene derivative (1) of the present invention includes the following general formulas (11) to (13). Among them, stilbene derivatives represented by the general formula (11) and (12) are preferably used.

(11)

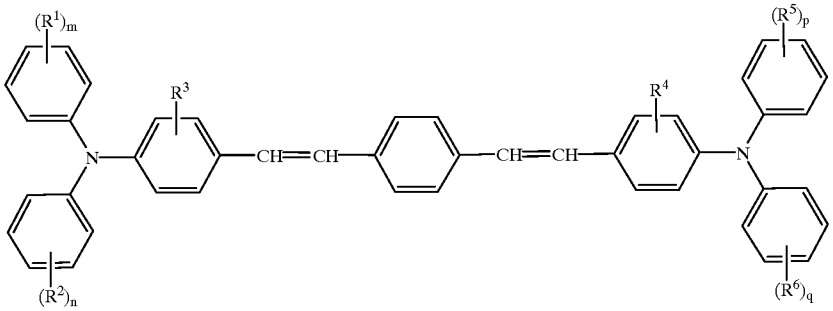

(12)

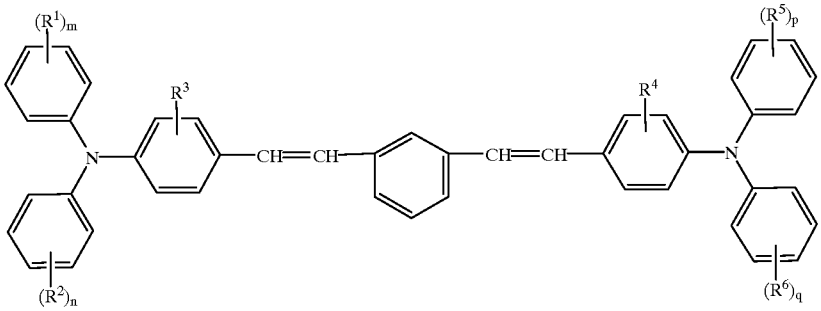

-continued (13)

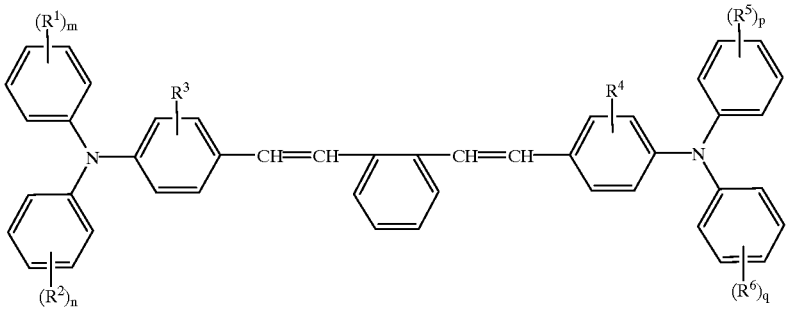

(wherein $R^1$ to $R^6$ and m to q are as defined above).

As the specific examples of the stilbene derivatives represented by the above general formula (11) and (12), substituents corresponding to $R^1$ to $R^6$ are shown in the following Tables 1 to 4. In Tables 1 to 4, those represented by a series of the compound numbers (11-1, 11-2, 11-3, . . . ) are stilbene derivatives included in the general formula (11), whereas, those represented by a series of the compound numbers (12-1, 12-2, 12-3, . . . ) are stilbene derivatives included in the general formula (12).

TABLE 1

| COMP. NO. | $R^1$ | $R^2$ | $R^3$ | $R^4$ | $R^5$ | $R^6$ |
|---|---|---|---|---|---|---|
| 11-1 | 4-Me | H | H | H | 4-Me | H |
| 12-1 | 4-Me | H | H | H | 4-Me | H |
| 11-2 | 4-Me | H | 2-Me | 2-Me | 4-Me | H |
| 12-2 | 4-Me | H | 2-Me | 2-Me | 4-Me | H |
| 11-3 | 4-Et | H | H | H | 4-Et | H |
| 12-3 | 4-Et | H | H | H | 4-Et | H |
| 11-4 | 4-Et | H | 2-Me | 2-Me | 4-Et | H |
| 12-4 | 4-Et | H | 2-Me | 2-Me | 4-Et | H |
| 11-5 | 4-Et | 4-Me | H | H | 4-Et | 4-Me |
| 12-5 | 4-Et | 4-Me | H | H | 4-Et | 4-Me |
| 11-6 | 4-Et | 4-Me | 2-Me | 2-Me | 4-Et | 4-Me |
| 12-6 | 4-Et | 4-Me | 2-Me | 2-Me | 4-Et | 4-Me |
| 11-7 | 4-Et | 3-Me | H | H | 4-Et | 3-Me |
| 12-7 | 4-Et | 3-Me | H | H | 4-Et | 3-Me |
| 11-8 | 4-Et | 3-Me | 2-Me | 2-Me | 4-Et | 3-Me |
| 12-8 | 4-Et | 3-Me | 2-Me | 2-Me | 4-Et | 3-Me |
| 11-9 | 4-iPr | H | H | H | 4-iPr | H |
| 12-9 | 4-iPr | H | H | H | 4-iPr | H |
| 11-10 | 4-iPr | 4-Me | H | H | 4-iPr | 4-Me |
| 12-10 | 4-iPr | 4-Me | H | H | 4-iPr | 4-Me |
| 11-11 | 4-iPr | 4-Me | 2-Me | 2-Me | 4-iPr | 4-Me |
| 12-11 | 4-iPr | 4-Me | 2-Me | 2-Me | 4-iPr | 4-Me |
| 11-12 | 4-iPr | 3-Me | H | H | 4-iPr | 3-Me |
| 12-12 | 4-iPr | 3-Me | H | H | 4-iPr | 3-Me |

TABLE 2

| COMP. NO. | $R^1$ | $R^2$ | $R^3$ | $R^4$ | $R^5$ | $R^6$ |
|---|---|---|---|---|---|---|
| 11-13 | 4-iPr | 3-Me | 2-Me | 2-Me | 4-iPr | 3-Me |
| 12-13 | 4-iPr | 3-Me | 2-Me | 2-Me | 4-iPr | 3-Me |
| 11-14 | 4-iPr | H | 2-Me | 2-Me | 4-iPr | H |
| 12-14 | 4-iPr | H | 2-Me | 2-Me | 4-iPr | H |
| 11-15 | 3-Me | H | H | H | 3-Me | H |
| 12-15 | 3-Me | H | H | H | 3-Me | H |
| 11-16 | 3-Me | H | 2-Me | 2-Me | 3-Me | H |
| 12-16 | 3-Me | H | 2-Me | 2-Me | 3-Me | H |
| 11-17 | 3, 4-Me | H | H | H | 3, 4-Me | H |
| 12-17 | 3, 4-Me | H | H | H | 3, 4-Me | H |

TABLE 2-continued

| COMP. NO. | $R^1$ | $R^2$ | $R^3$ | $R^4$ | $R^5$ | $R^6$ |
|---|---|---|---|---|---|---|
| 11-18 | 3, 4-Me | H | 2-Me | 2-Me | 3, 4-Me | H |
| 12-18 | 3, 4-Me | H | 2-Me | 2-Me | 3, 4-Me | H |
| 11-19 | 3, 4-Me | 4-Me | H | H | 3, 4-Me | 4-Me |
| 12-19 | 3, 4-Me | 4-Me | H | H | 3, 4-Me | 4-Me |
| 11-20 | 3, 4-Me | 4-Me | 2-Me | 2-Me | 3, 4-Me | 4-Me |
| 12-20 | 3, 4-Me | 4-Me | 2-Me | 2-Me | 3, 4-Me | 4-Me |
| 11-21 | 3, 4-Me | 3-Me | H | H | 3, 4-Me | 3-Me |
| 12-21 | 3, 4-Me | 3-Me | H | H | 3, 4-Me | 3-Me |
| 11-22 | 3, 4-Me | 3-Me | 2-Me | 2-Me | 3, 4-Me | 3-Me |
| 12-22 | 3, 4-Me | 3-Me | 2-Me | 2-Me | 3, 4-Me | 3-Me |
| 11-23 | 4-tBu | H | H | H | 4-tBu | H |
| 12-23 | 4-tBu | H | H | H | 4-tBu | H |
| 11-24 | 4-tBu | 4-Me | H | H | 4-tBu | 4-Me |
| 12-24 | 4-tBu | 4-Me | H | H | 4-tBu | 4-Me |

TABLE 3

| COMP. NO. | $R^1$ | $R^2$ | $R^3$ | $R^4$ | $R^5$ | $R^6$ |
|---|---|---|---|---|---|---|
| 11-25 | 4-tBu | 4-Me | 2-Me | 2-Me | 4-tBu | 4-Me |
| 12-25 | 4-tBu | 4-Me | 2-Me | 2-Me | 4-tBu | 4-Me |
| 11-26 | 4-tBu | 3-Me | 2-Me | 2-Me | 4-tBu | 3-Me |
| 12-26 | 4-tBu | 3-Me | 2-Me | 2-Me | 4-tBu | 3-Me |
| 11-27 | 4-tBu | H | 2-Me | 2-Me | 4-tBu | H |
| 12-27 | 4-tBu | H | 2-Me | 2-Me | 4-tBu | H |
| 11-28 | 3, 5-Me | H | 2-Me | 2-Me | 3, 5-Me | H |
| 12-28 | 3, 5-Me | H | 2-Me | 2-Me | 3, 5-Me | H |
| 11-29 | 3, 5-Me | 4-Me | 2-Me | 2-Me | 3, 5-Me | 4-Me |
| 12-29 | 3, 5-Me | 4-Me | 2-Me | 2-Me | 3, 5-Me | 4-Me |
| 11-30 | 3, 5-Me | 4-Et | 3-Me | 3-Me | 3, 5-Me | 4-Et |
| 12-30 | 3, 5-Me | 4-Et | 3-Me | 3-Me | 3, 5-Me | 4-Et |
| 11-31 | 3, 5-Me | 4-iPr | 2-Me | 2-Me | 3, 5-Me | 4-iPr |
| 12-31 | 3, 5-Me | 4-iPr | 2-Me | 2-Me | 3, 5-Me | 4-iPr |
| 11-32 | 2, 3-Me | H | 2-Me | 2-Me | 2, 3-Me | H |
| 12-32 | 2, 3-Me | H | 2-Me | 2-Me | 2, 3-Me | H |
| 11-33 | 2, 3-Me | 4-Me | 3-Me | 3-Me | 2, 3-Me | 4-Me |
| 12-33 | 2, 3-Me | 4-Me | 3-Me | 3-Me | 2, 3-Me | 4-Me |
| 11-34 | 2, 3-Me | 4-Et | 3-Me | 3-Me | 2, 3-Me | 4-Et |
| 12-34 | 2, 3-Me | 4-Et | 3-Me | 3-Me | 2, 3-Me | 4-Et |
| 11-35 | 2, 3-Me | 4-iPr | 2-Me | 2-Me | 2, 3-Me | 4-iPr |
| 12-35 | 2, 3-Me | 4-iPr | 2-Me | 2-Me | 2, 3-Me | 4-iPr |
| 11-36 | 4-MeO | H | H | H | 4-MeO | H |
| 12-36 | 4-MeO | H | H | H | 4-MeO | H |

TABLE 4

| COMP. NO. | $R^1$ | $R^2$ | $R^3$ | $R^4$ | $R^5$ | $R^6$ |
|---|---|---|---|---|---|---|
| 11-37 | 4-MeO | H | 2-Me | 2-Me | 4-MeO | H |
| 12-37 | 4-MeO | H | 2-Me | 2-Me | 4-MeO | H |
| 11-38 | 4-MeO | 3-Me | 2-Me | 2-Me | 4-MeO | 3-Me |
| 12-38 | 4-MeO | 3-Me | 2-Me | 2-Me | 4-MeO | 3-Me |
| 11-39 | 4-Et | 2-Me | 3-Me | 3-Me | 4-Et | 2-Me |
| 12-39 | 4-Et | 2-Me | 3-Me | 3-Me | 4-Et | 2-Me |
| 11-40 | 4-iPr | 2-Me | 3-Me | 3-Me | 4-iPr | 2-Me |
| 12-40 | 4-iPr | 2-Me | 3-Me | 3-Me | 4-iPr | 2-Me |
| 11-41 | 4-Me | H | H | H | 4-Et | H |
| 12-41 | 4-Me | H | H | H | 4-Et | H |
| 11-42 | 4-Me | H | H | H | 4-iPr | H |
| 12-42 | 4-Me | H | H | H | 4-iPr | H |
| 11-43 | 4-Et | 3-Me | 2-Me | H | 4-iPr | H |
| 12-43 | 4-Et | 3-Me | 2-Me | H | 4-iPr | H |
| 11-44 | 4-Et | H | H | H | 4-iPr | H |
| 12-44 | 4-Et | H | H | H | 4-iPr | H |

In Tables 1 to 4, "Me" represents a methyl group, "Et" represents an ethyl group, "iPr" represents an isopropyl group, "tBu" represents a t-butyl group, and "MeO" represents a methoxy group. "2-", "3-" and "4-" represent a substitution position in a phenyl group. The case where the numeral larger than 2 is present (e.g. "2,3-", "3,5-", etc.) represents that the corresponding phenyl group has two or more groups. That is, for example, "4-iPr" represents that an isopropyl group is substituted on the 4-position (para-position) of the phenyl group and "2,3-Me" represents that a methyl group is substituted on the 2-position (ortho-position) and the 3-position (meta-position) of the phenyl group. Incidentally, the number of the substitution position is as shown in the following formula.

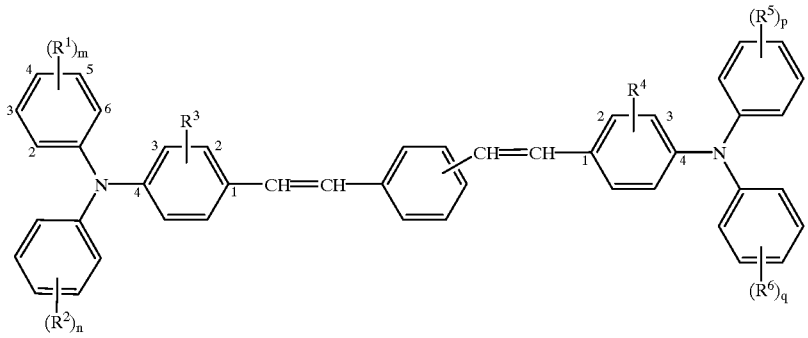

(1)

(wherein $R^1$ to $R^6$ and m to q are as defined above)

The method of synthesizing the stilbene derivative (1) of the present invention will be described by way of the case where $R^1=R^5$, m=p, $R^2=R^3=R^4=R^6$, and $R^2$ is a hydrogen atom as the example.

In this case, as shown in the following reaction scheme (I), an aniline derivative (90) and iodobenzene (91) as a starting material are first added in a solvent such as nitrobenzene in a proportion of 1:2 (molar ratio) and the mixture is refluxed in the presence of a catalyst such as anhydrous potassium carbonate, copper or the like, thereby to synthesize a triphenylamine derivative (92). Then, the triphenylamine derivative (92) is added in a solvent such as dimethyl formamide, N-methylformanilide or the like and the mixture is formylated by reacting in the presence of phosphorous oxychloride.

Reaction scheme (I)

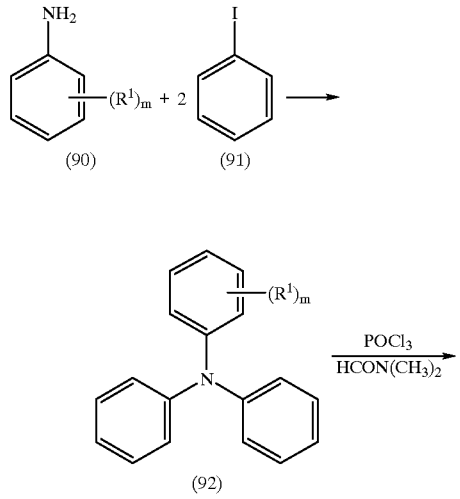

-continued

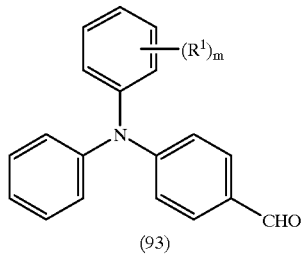

(wherein $R^1$ and m are as defined above)

As shown in the following reaction scheme (II), a stilbene derivative (I') is obtained by adding dropwise a formyl compound (93) of triphenylamine to a bisphosphate derivative (94) dissolved in a solvent such as tetrahydrofuran in a proportion of 1:2 (molar ratio) and reacting them.

Reaction scheme (II)

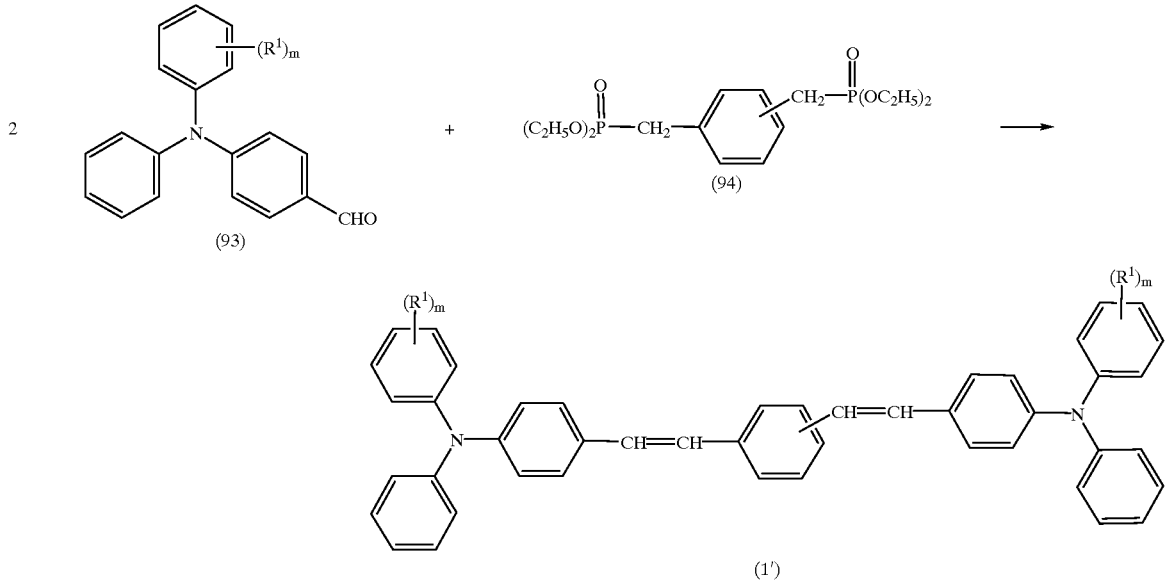

(wherein $R^1$ and m are as defined above)

On the other hand, when the configuration of the stilbene derivative (1) is unasymmetric, as shown in the following reaction scheme (III), methylbenzyl chloride (95) is first reacted with triphosphite to synthesize monophosphate (96), which is then reacted with a formyl compound (93') of the above triphenylamine to obtain a monostilbene derivative (97), which is further chlorinated to obtain a derivative (98).

Reaction scheme (III)

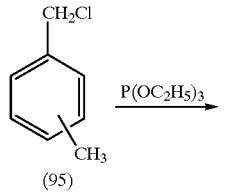

-continued

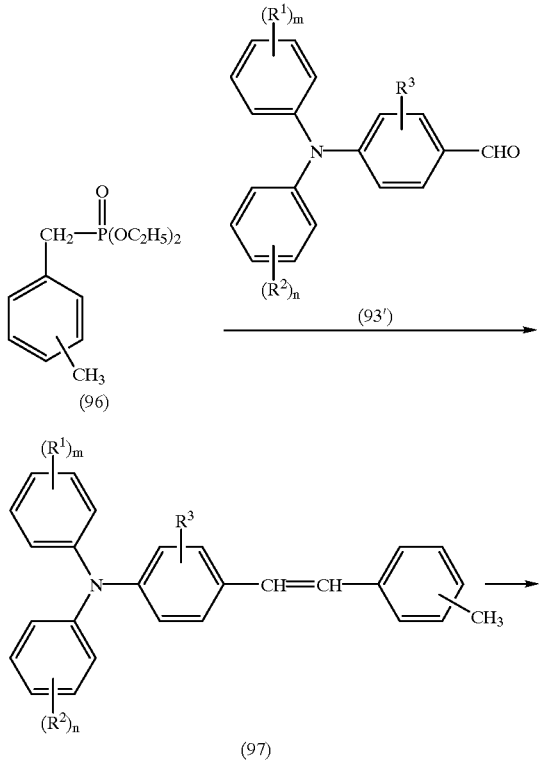

-continued
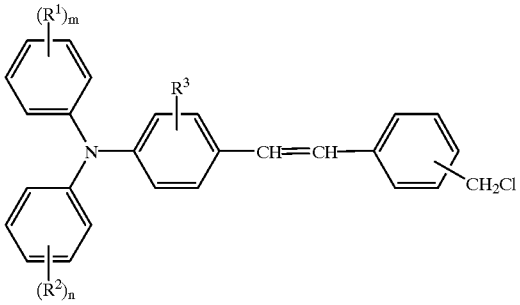
(98)
(wherein $R^1$ to $R^3$ and m and n are as defined above)
As shown in the following reaction scheme (IV), the above derivative (98) is then reacted with triphosphite to obtain a compound (99), which is reacted with a formyl compound (93") of triphenylamine to obtain a stilbene derivative (1).
Reaction scheme (IV)
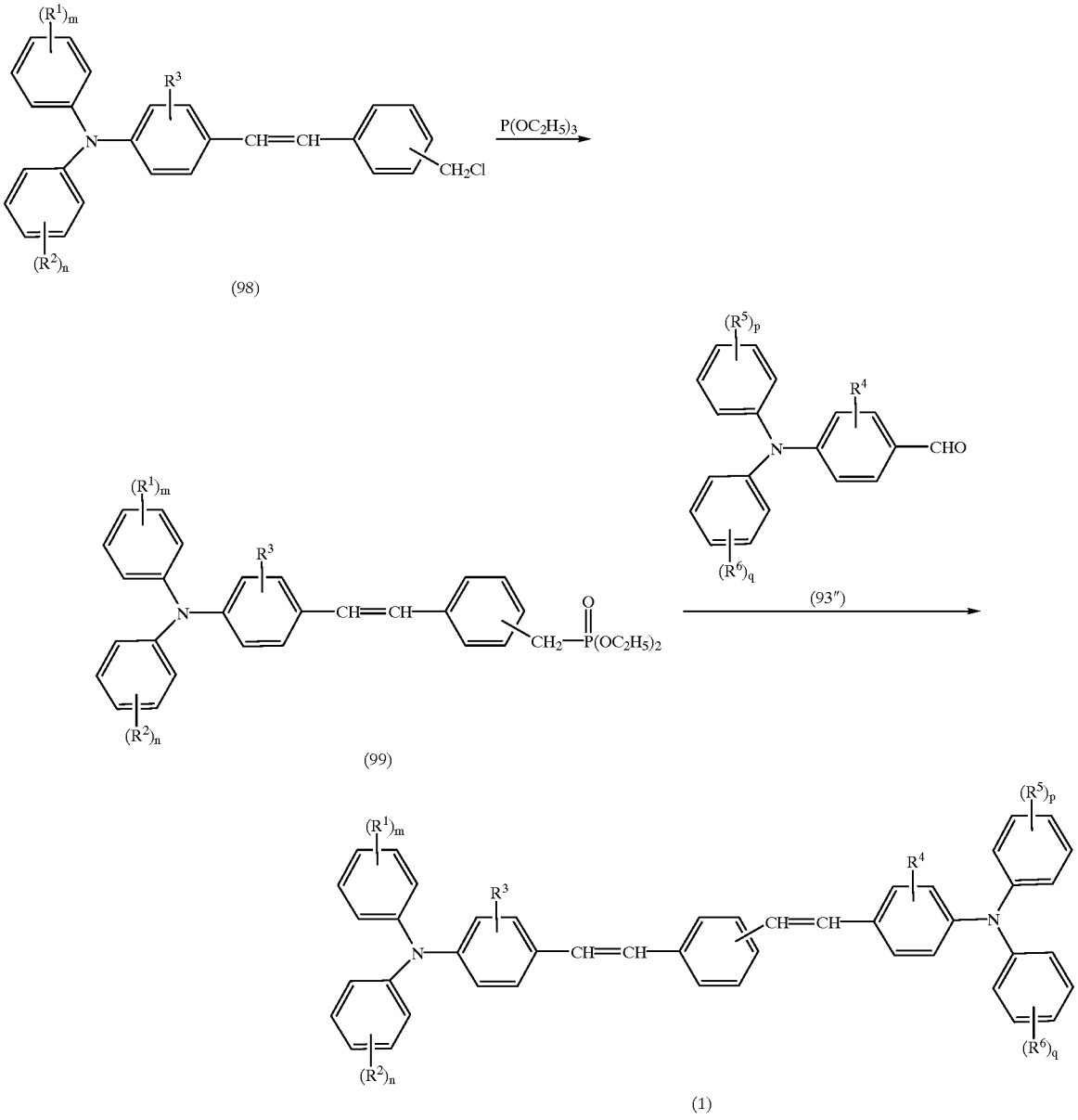
(98)
(99)
(1)

(wherein $R^1$ to $R^6$ and m to q are as defined above)

The electron transferring material used in the electrophotosensitive material of the present invention will be described hereinafter.

In the electron transferring materials represented by the above general formulas (2) to (5), the alkyl group, alkoxy group, aryl group, aralkyl group and halogen atom, which correspond to $R^7$ to $R^{21}$, include the same groups as those described above. Examples of the cycloalkyl group include groups having 3 to 8 carbon atoms, such as cyclopropyl, cyclobutyl, cyclopentyl, cyclohexyl, cycloheptyl, cyclooctyl and the like. The alkyl group and halogen atom in the halogenated alkyl group include the same groups as those described above.

Examples of the substituent, which may be substituted on the above alkyl group, include halogen atom, amino group, hydroxyl group, optionally esterified carboxyl group, cyano group, alkoxy group having 1 to 6 carbon atoms, alkenyl group having 2 to 6 carbon atoms which may have an aryl group, and the like. Examples of the above alkenyl group include groups having 2 to 6 carbon atoms, such as vinyl, allyl, 2-butenyl, 3-butenyl, 1-methylallyl, 2-pentenyl, 2-hexenyl and the like.

Examples of the substituent, which may be substituted on the above aryl group, include halogen atom, amino group, hydroxyl group, optionally esterified carboxyl group, cyano group, alkyl group having 1 to 6 carbon atoms, alkoxy group having 1 to 6 carbon atoms, alkenyl group having 2 to 6 carbon atoms which may have an aryl group, and the like. Examples of the above alkenyl group include groups having 2 to 6 carbon atoms, such as vinyl, allyl, 2-butenyl, 3-butenyl, 1-methylallyl, 2-pentenyl, 2-hexenyl and the like.

The electrophotosensitive material of the present invention will be described hereinafter.

The electrophotosensitive material of the present invention is a single-layer type photosensitive material obtained by providing a single photosensitive layer containing one or more stilbene derivatives represented by the above general formula (1) and an electron transferring material on a conductive substrate.

The above photosensitive layer is formed by dissolving or dispersing a stilbene derivative (hole transferring material) represented by the general formula (1), an electron transferring material, an electric charge material and a binding resin in a suitable solvent, applying the resulting coating solution on a conductive substrate and drying the coating solution.

The electrophotosensitive material of the present invention can be applied to any of positive and negative charging types, but is preferably used in the positive charging type.

In the electrophotosensitive material of the present invention, since the hole transferring material and electron transferring material are used in combination as the electric charge transferring material in a single photosensitive layer, giving and receiving of electric charges between the electric charge generating material and electric charge transferring material are satisfactorily conducted. Accordingly, according to the present invention, there can be obtained a high-sensitivity photosensitive material.

Various materials used in the electrophotosensitive material will be described hereinafter.

Electric Charge Generating Material

Examples of the electric charge generating material used in the present invention include compounds represented by the following general formulas (CG1) to (CG12).

(CGI) Metal-free phthalocyanine (CG1)

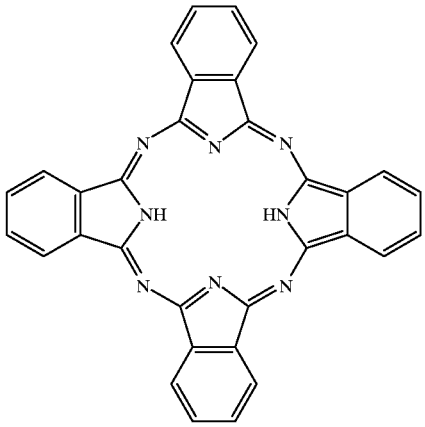

(CG2) Oxotitanyl phthalocyanine (CG2)

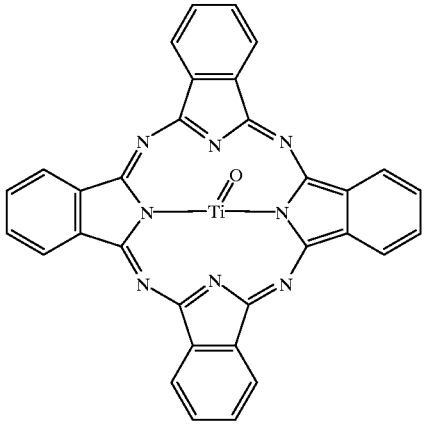

(CG3) Perylene pigment (CG3)

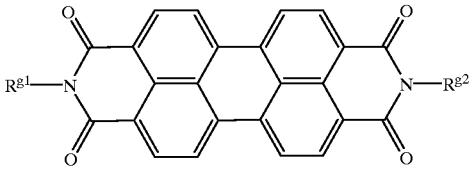

(wherein $R^{g1}$ and $R^{g2}$ are the same or different and represent a substituted or non-substituted alkyl group having 18 or less carbon atoms, a cycloalkyl group, an aryl group, an alkanoyl group or an aralkyl group)

(CG4) Bisazo pigment $$Cp^1—N=N—Q—N=N—Cp^2 \quad (CG4)$$

[wherein $Cp^1$ and $Cp^2$ are the same or different and represent a coupler residue; and Q represents a group represented by the following formula:

(Q-1)

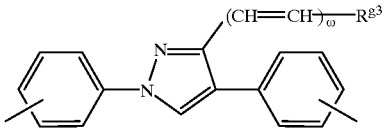

(wherein $R^{g3}$ represents a hydrogen atom, an alkyl group, an aryl group or a heterocyclic group, and the alkyl group, aryl group or heterocyclic group may have a substituent; and ω represents 0 or 1), (Q-2)

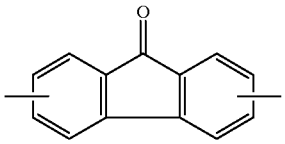

(Q-3)

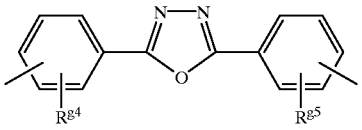

(wherein $R^{g4}$ and $R^{5g}$ are the same or different and represents a hydrogen atom, an alkyl group having 1 to 5 carbon atoms, a halogen atom, an alkoxy group, an aryl group or an aralkyl group), (Q-4)

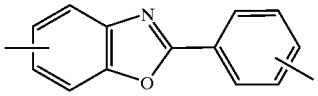

(Q-5)

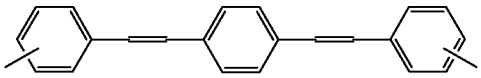

(Q-6)

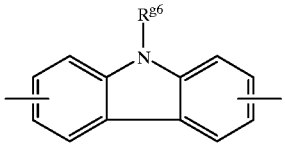

(wherein $R^{g6}$ represents a hydrogen atom, an ethyl group, a chloroethyl group or a hydroxyethyl group), or (Q-7)

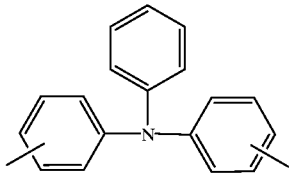

(Q-8)

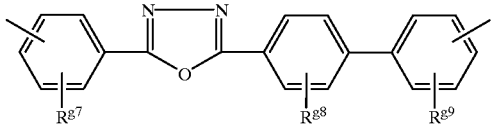

(wherein $R^{g7}$, $R^{g8}$ and $R^{g9}$ are the same or different and represent a hydrogen atom, an alkyl group having 1 to 5 carbon atoms, a halogen atom, an alkoxy group, an aryl group or an aralkyl group)]

(CG5) Dithioketopyrrolopyrrole pigment (CG5)

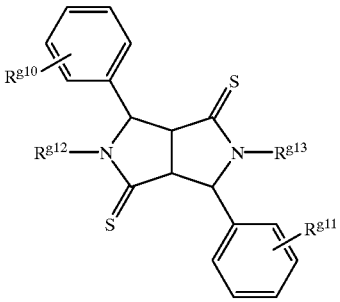

(wherein $R^{g10}$ and $R^{g11}$ are the same or different and represent a hydrogen atom, an alkyl group, an alkoxy group or a halogen atom; and $R^{g12}$ and $R^{g13}$ are the same or different and represent a hydrogen atom, an alkyl group or an aryl group)

(CG6) Metal-free naphthalocyanine pigment (CG6)

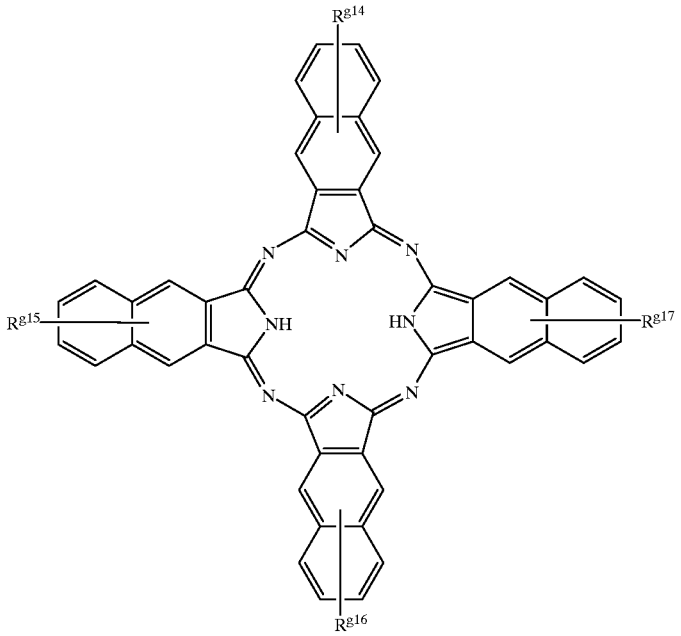

(wherein $R^{g14}$, $R^{g15}$, $R^{g16}$ and $R^{g17}$ are the same or different and represent a hydrogen atom, an alkoxy group or a halogen atom)

(CG7) Metal phthalocyanine pigment (CG7)

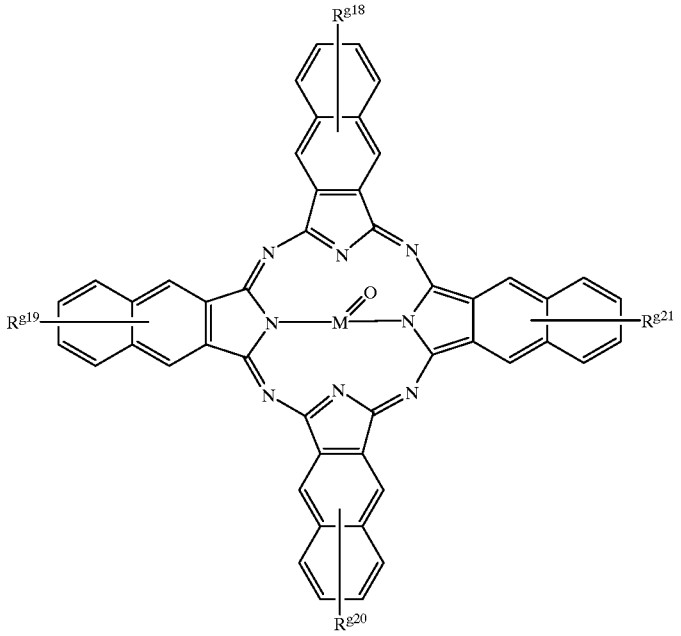

(wherein $R^{g18}$, $R^{g19}$, $R^{g20}$ and $R^{g21}$ are the same or different and represent a hydrogen atom, an alkyl group, an alkoxy group or a halogen atom; and M represents Ti or V)

(CG8) Squaline pigment (CG8)

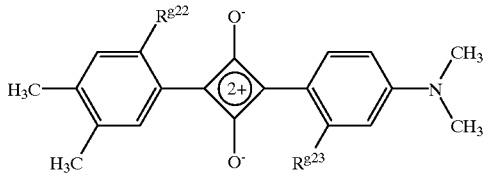

(wherein $R^{g22}$ and $R^{g23}$ are the same or different and represent a hydrogen atom, an alkyl group, an alkoxy group or a halogen atom)

(CG9) Trisazo pigment (CG9)

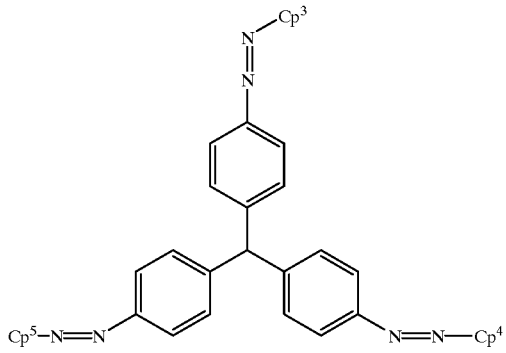

(wherein $Cp^3$, $Cp^4$ and $Cp^5$ are the same or different and represent a coupler residue)

(CG10) Indigo pigment (CG10)

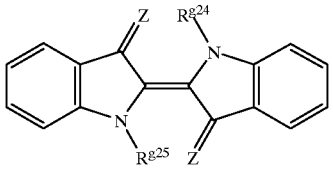

(wherein $R^{g24}$ and $R^{g25}$ are the same or different and represent a hydrogen atom, an alkyl group or an aryl group; and Z is an oxygen atom or a sulfur atom)

(CG11) Azulenium pigment (CG11)

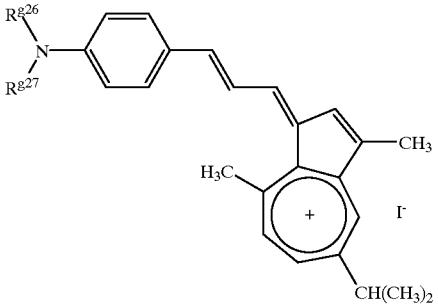

(wherein $R^{g26}$ and $R^{g27}$ are the same or different and represent a hydrogen atom, an alkyl group or an aryl group)

(CG12) Cyanine pigment (CG12)

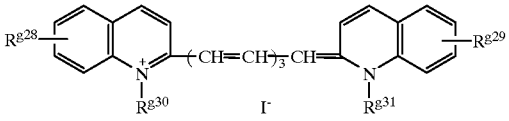

(wherein $R^{g28}$ and $R^{g29}$ are the same or different and represent a hydrogen atom, an alkyl group, an alkoxy group or a halogen atom; and $R^{g30}$ and $R^{g31}$ are the same or different and represent a hydrogen atom, an alkyl group or an aryl group)

In the above electric charge generating material, examples of the alkyl group, alkoxy group, aryl group, aralkyl group, cycloalkyl group and halogen atom include the same groups as those described above. Examples of the substituted or non-substituted alkyl group having 18 or less carbon atoms include groups such as heptyl, octyl, nonyl, decyl, dodecyl, tridecyl, pentadecyl, octadecyl and the like, in addition to the alkyl group having 1 to 6 carbon atoms. Examples of the alkanoyl group include formyl, acetyl, propionyl, butyryl, pentanoyl, hexanoyl and the like.

Examples of the heterocyclic group include thienyl, furyl, pyrrolyl, pyrrolidinyl, oxazolyl, isoxazolyl, thiazolyl, isothiazolyl, imidazolyl, 2H-imidazoyl, pyrazolyl, triazolyl, tetrazolyl, pyranyl, pyridyl, piperidyl, piperidino, 3-morpholinyl, morpholino, thiazolyl and the like. It may also be a heterocyclic group condensed with an aromatic ring.

Examples of the substituent, which may be substituted on the above alkyl group, include halogen atom, amino group, hydroxyl group, optionally esterified carboxyl group, cyano group, alkoxy group having 1 to 6 carbon atoms, alkenyl group having 2 to 6 carbon atoms which may have an aryl group and the like.

Examples of the substituent, which may be substituted on the above aryl group and heterocyclic group, include halogen atom, amino group, hydroxyl group, optionally esterified carboxyl group, cyano group, alkyl groups having 1 to 6 carbon atoms, alkoxy group having 1 to 6 carbon atoms, alkenyl group having 2 to 6 carbon atoms which may have an aryl group and the like.

Examples of the coupler residue represented by $Cp^1$, $Cp^2$, $Cp^3$, $Cp^4$ and $Cp^5$ include the groups shown in the following formulas (Cp-1) to (Cp-11).

(Cp-1)

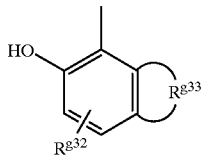

(Cp-2)

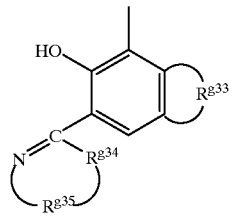

(Cp-3)

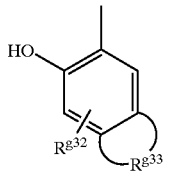

(Cp-4)

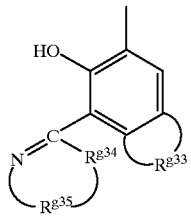

(Cp-5)

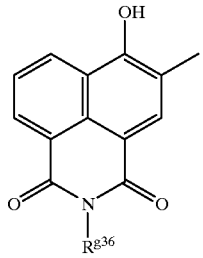

(Cp-6)

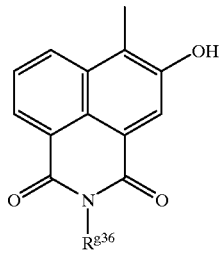

-continued (Cp-7)

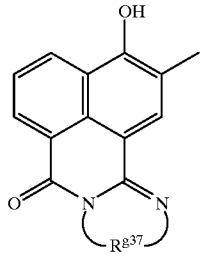

(Cp-8)

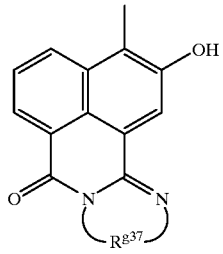

(Cp-9)

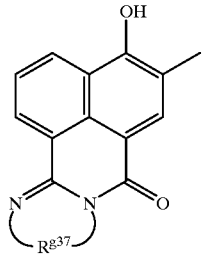

(Cp-10)

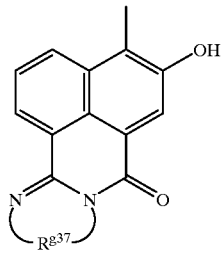

(Cp-11)

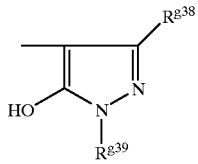

In the respective formulas, $R^{g32}$ represents a carbamoyl group, a sulfamoyl group, an allophanoyl group, an oxamoyl group, an anthraninoyl group, a carbazoyl group, a glycyl group, a hydantoyl group, a phthalamoyl group or a succinamoyl group. These groups may have substituents such as halogen atom, phenyl group which may have a substituent, naphthyl group which may have a substituent, nitro group, cyano group, alkyl group, alkenyl group, carbonyl group, carboxyl group and the like.

$R^{g33}$ represents an atomic group which is required to form an aromatic ring, a polycyclic hydrocarbon or a heterocycle by condensing with a benzene ring, and these rings may have the same substituent as that described above.

$R^{g34}$ represents an oxygen atom, a sulfur atom or an imino group.

$R^{g35}$ represents a divalent chain hydrocarbon or an aromatic hydrocarbon group, and these groups may have the same substituent as that described above.

$R^{g36}$ represents an alkyl group, an aralkyl group, an aryl group or a heterocyclic group, and these groups may have the same substituent as that described above.

$R^{g37}$ represents an atomic group which is required to form a heterocycle, together with a divalent chain hydrocarbon or aromatic hydrocarbon group or two nitrogen atoms in the above formulas (Cp-1) to (Cp-11), and these rings may have the same substituent as that described above.

$R^{g38}$ represents a hydrogen atom, an alkyl group, an amino group, a carbamoyl group, a sulfamoyl group, an allophanoyl group, a carboxyl group, an alkoxycarbonyl group, an aryl group or a cyano group, and the groups other than a hydrogen atom may have the same substituent as that described above.

$R^{g39}$ represents an alkyl group or an aryl group, and these groups may have the same substituent as that described above.

Examples of the alkenyl group include alkenyl groups having 2 to 6 carbon atoms, such as vinyl, allyl, 2-butenyl, 3-butenyl, 1-methylallyl, 2-pentenyl, 2-hexenyl and the like.

In the above $R^{g33}$, examples of the atomic group which is required to form an aromatic ring by condensing with a benzene ring include alkylene groups having 1 to 4 carbon atoms, such as methylene, ethylene, trimethylene, tetramethylene and the like.

Examples of the aromatic ring to be formed by condensing the above $R^{g33}$ with a benzene ring include naphthalene ring, anthracene ring, phenanthrene ring, pyrene ring, chrysene ring, naphthacene ring and the like.

In the above $R^{g33}$, examples of the atomic group which is required to form a polycyclic hydrocarbon by condensing with a benzene ring include the above alkylene groups having 1 to 4 carbon atoms, or carbazole ring, benzocarbazole ring, dibenzofuran ring and the like.

In the above $R^{g33}$, examples of the atomic group which is required to form a heterocycle by condensing with a benzene ring include benzofuranyl, benzothiophenyl, indolyl, 1H-indolyl, benzoxazoyl, benzothiazolyl, 1H-indadolyl, benzoimidazolyl, chromenyl, chromanyl, isochromanyl, quinolinyl, isoquinolinyl, cinnolinyl, phthalazinyl, quinazolinyl, quinoxalinyl, dibenzofranyl, carbazoyl, xanthenyl, acridinyl, phenanthridinyl, phenazinyl, phenoxazinyl, thianthrenyl and the like.

Examples of the aromatic heterocyclic group to be formed by condensing the above $R^{g33}$ and the benzene ring include thienyl, furyl, pyrrolyl, oxazolyl, isoxazolyl, thiazolyl, isothiazolyl, imidazolyl, pyrazolyl, triazolyl, tetrazolyl, pyridyl, thiazolyl and the like. In addition, it may also be a heterocyclic group condensed with the other aromatic ring (e.g. benzofuranyl, benzimidazolyl, benzoxazolyl, benzothiazolyl, quinolyl, etc.).

In the above $R^{g35}$ and $R^{g37}$, examples of the divalent chain hydrocarbon include ethylene, trimethylene, tetramethylene and the like. Examples of the divalent aromatic hydrocarbon include phenylene, naphthylene, phenanthrilene and the like.

In the above $R^{g36}$, examples of the heterocyclic group include pyridyl, pyrazyl, thienyl, pyranyl, indolyl and the like.

In the above $R^{g37}$, examples of the atomic group which is required to form a heterocycle, together with two nitrogen atoms, include phenylene, naphthylene, ethylene, trimethylene, tetramethylene and the like.

Examples of the aromatic heterocyclic group to be formed by the above $R^{g37}$ and two nitrogen atoms include benzimidazole, benzo[f]benzimidazole, dibenzo[e,g] benzoimidazole, benzopyrimidine and the like. These groups may have the same group as that described above.

In the above $R^{g38}$, examples of the alkoxycarbonyl group include methoxycarbonyl, ethoxycarbonyl, propoxycarbonyl, butoxycarbonyl and the like.

In the present invention, there can be used conventionally known electric charge generating materials, for example, powders of inorganic photoconductive materials (e.g. selenium, selenium-tellurium, cadmium sulfide, amorphous silicon, etc.), pyrilium salt, anthanthrone pigments, triphenylmethane pigments, threne pigments, toluidine pigments, pyrazoline pigments, quinacridone pigments and the like, in addition to the above electric charge generating materials.

The above electric charge generating materials can be used alone or in combination thereof so as to have an absorption wavelength within a desired range.

Since a photosensitive material having sensitivity at the wavelength range of 700 nm or more is required in digital-optical image forming apparatuses such as laser beam printer using a light source of semiconductor laser, facsimile, etc., a phthalocyanine pigments such as metal-free phthalocyanine represented by the above general formula (CG1), oxotitanyl phthalocyanine represented by the general formula (CG2), etc. are preferably used among the above electric charge generating material. Incidentally, the crystal form of the above phthalocyanine pigments is not specifically limited, and various phthalocyanine pigments can be used.

In analog-optical image forming devices such as electrostatic copying machine using a white light source such as halogen lamp, etc., a photosensitive material having sensitivity at the visible range is required. Therefore, for example, the perylene pigment represented by the above general formula (CG3) and bisazo pigment represented by the general formula (CG4) are suitably used.

Hole Transferring Material

In the electrophotosensitive material of the present invention, a stilbene derivative (1) as the hole transferring material of the present invention may be contained in the photosensitive layer, together with conventionally known hole transferring materials.

Examples of the hole transferring material include various compounds having high hole transferring capability, for example, compounds represented by the following general formulas (HT1) to (HT13):

(HT1)

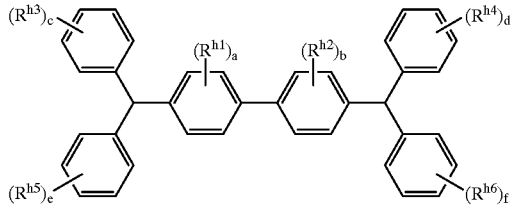

(wherein $R^{h1}$, $R^{h2}$, $R^{h3}$, $R^{h4}$, $R^{h5}$ and $R^{h6}$ are the same or different and represent a halogen atom, an alkyl group which may have a substituent, an alkoxy group which may have a substituent, or an aryl group which may have a substituent; a and b are the same or different and represent an integer of 0 to 4; and c, d, e and f are the same or different and represent an integer of 0 to 5, with the proviso that different groups may be substituted on the same benzene ring when a, b, c, d, e or f is 2 or more)

(HT2)

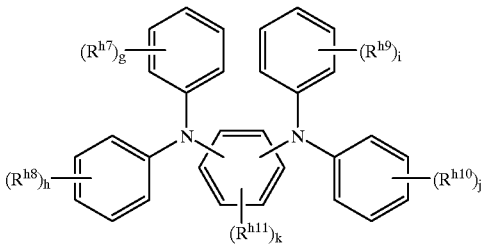

(wherein $R^{h7}$, $R^{h8}$, $R^{h9}$, $R^{h10}$ and $R^{h11}$ are the same or different and represent a halogen atom, an alkyl group which may have a substituent, an alkoxy group which may have a substituent, or an aryl group which may have a substituent; g, h, i and j are the same or different and represent an integer of 0 to 5; and k is an integer of 1 to 4, with the proviso that different groups may be substituted on the same benzene ring when g, h, i, j or k is 2 or more)

(HT3)

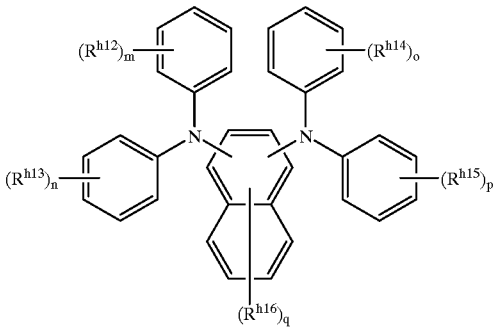

(wherein $R^{h12}$, $R^{h13}$, $R^{h14}$ and $R^{h15}$ are the same or different and represent a halogen atom, an alkyl group which may have a substituent, an alkoxy group which may have a substituent, or an aryl group which may have a substituent; $R^{h16}$ is a halogen atom, a cyano group, a nitro group, an alkyl group which may have a substituent, an alkoxy which may have a substituent, or an aryl group which may have a substituent; m, n, o and p are the same or different and represent an integer of 0 to 5; and q is an integer of 0 to 6, with the proviso that different groups may be substituted on the same benzene or naphthalene ring when m, n, o, p or q is 2 or more)

(HT4)

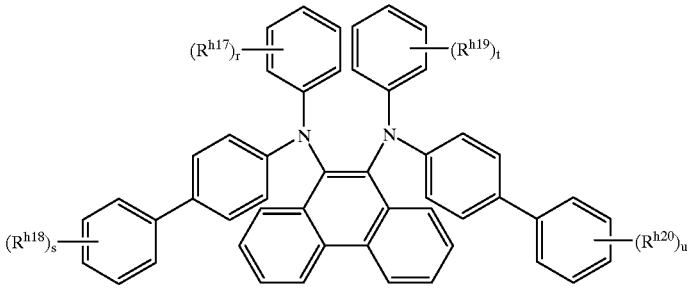

(wherein $R^{h17}$, $R^{h18}$, $R^{h19}$ and $R^{h20}$ are the same or different and represent an alkyl group which may have a substituent, an alkoxy group which may have a substituent, or an aryl group which may have a substituent; r, s, t and u are the same or different and represent an integer of 0 to 5, with the proviso that different groups may be substituted on the same benzene ring when r, s, t or u is 2 or more)

(HT5)

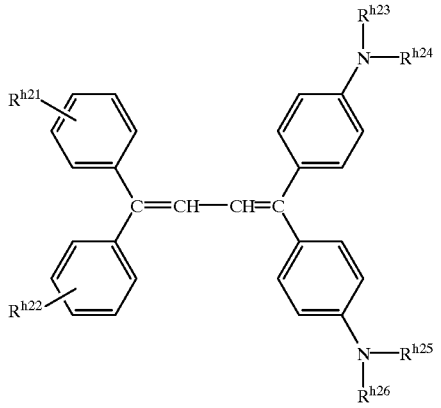

(wherein $R^{h21}$ and $R^{h22}$ are the same or different and represent a hydrogen atom, a halogen atom, an alkyl group or an alkoxy group; and $R^{h23}$, $R^{h24}$, $R^{h25}$ and $R^{h26}$ may be same or different and represent a hydrogen atom, an alkyl group or an aryl group)

(HT6)

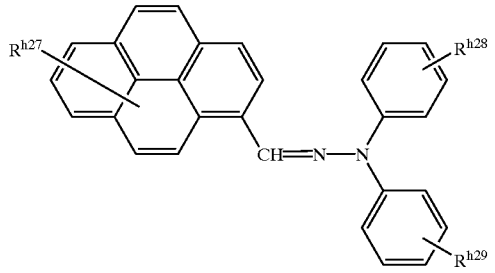

(wherein $R^{h27}$, $R^{h28}$ and $R^{h29}$ are the same or different and represent a hydrogen atom, a halogen atom, an alkyl group or an alkoxy group)

(HT7)

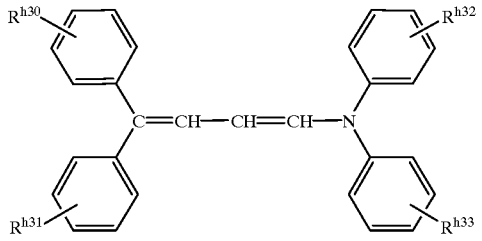

(wherein $R^{h30}$, $R^{h31}$, $R^{h32}$ and $R^{h33}$ may be same or different and represent a hydrogen atom, a halogen atom, an alkyl group or an alkoxy group)

(HT8)

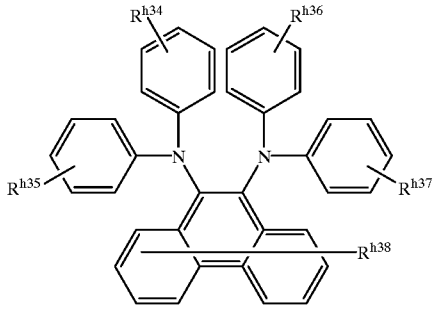

(wherein $R^{h34}$, $R^{h35}$, $R^{h36}$, $R^{h375}$ and $R^{h38}$ may be same or different and represent a hydrogen atom, a halogen atom, an alkyl group or an alkoxy group)

(HT9)

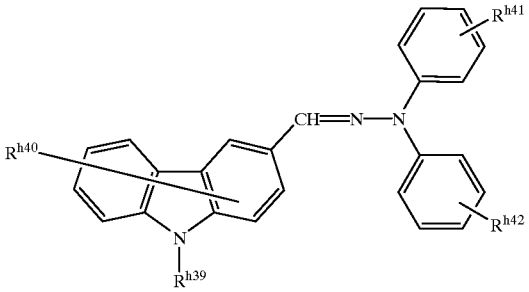

(wherein $R^{h39}$ is a hydrogen atom or an alkyl group; and $R^{h40}$, $R^{h41}$ and $R^{h42}$ may be same or different and represent a hydrogen atom, a halogen atom, an alkyl group or an alkoxy group)

(HT10)

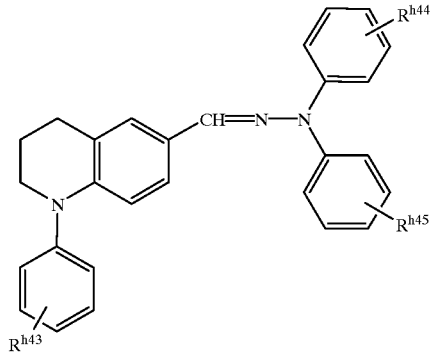

(wherein $R^{h43}$, $R^{h44}$ and $R^{h45}$ may be same or different and represent a hydrogen atom, a halogen atom, an alkyl group or an alkoxy group)

(HT11)

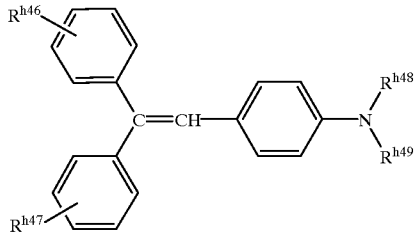

(wherein $R^{h46}$ and $R^{h47}$ are the same or different and represent a hydrogen atom, a halogen atom, an alkyl group which may have a substituent, or an alkoxy group which may have a substituent; and $R^{h48}$ and $R^{h49}$ are the same or different and represent a hydrogen atom, an alkyl group which may have a substituent, or an aryl group which may have a substituent)

(HT12)

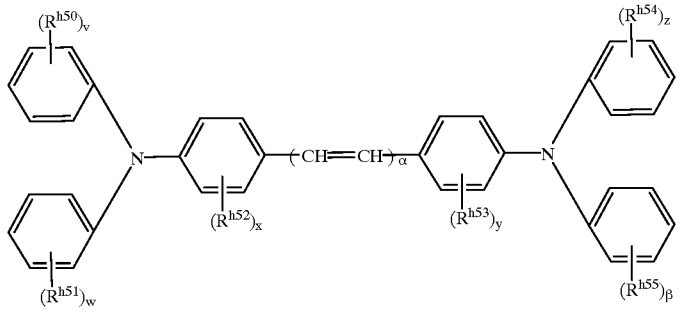

(wherein $R^{h50}$, $R^{h51}$, $R^{h52}$, $R^{h53}$, $R^{h54}$ and $R^{h55}$ are the same or different and represent an alkyl group which may have a substituent, an alkoxy group which may have a substituent, or an aryl group which may have a substituent; α is an integer of 1 to 10; v, w, x, y, z and β are the same or different and represent an integer of 0 to 2, with the proviso that different groups may be substituted on the same benzene ring when v, w, x, y, z or β is 2)

(HT13)

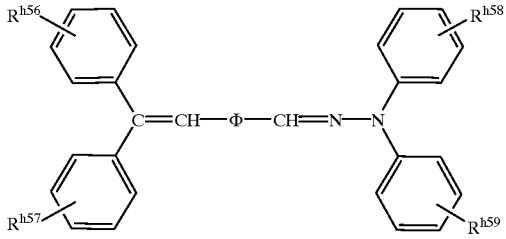

(wherein $R^{h56}$, $R^{h57}$, $R^{h58}$ and $R^{h59}$ may be same or different and represent a hydrogen atom, a halogen atom, an alkyl group or an alkoxy group; and Φ represent a group (Φ-1), (Φ-2) or (Φ-3) represented by the formulas:

(Φ-1)

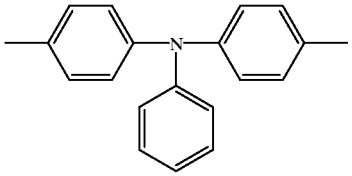

(Φ-2)

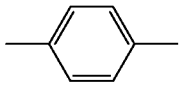

(Φ-3)

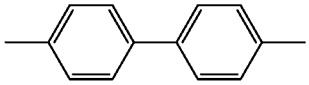

In the hole transferring material as described above, examples of the alkyl group, alkoxy group and aryl group include the same groups as those described above.

Examples of the substituent, which may be substituted on the above alkyl group and alkoxy group, include halogen atom, amino group, hydroxyl group, optionally esterified carboxyl group, cyano group, alkoxy group having 1 to 6 carbon atoms, alkenyl group having 2 to 6 carbon atoms which may have an aryl group, etc. In addition, the substitution position of the substituent is not specifically limited.

Examples of the substituent, which may be substituted on the above aryl group, include halogen atom, amino group, hydroxyl group, optionally esterified carboxyl group, cyano group, alkyl group having 1 to 6 carbon atoms, alkoxy group having 1 to 6 carbon atoms, alkenyl group having 2 to 6 carbon atoms which may have an aryl group, etc. In addition, the substitution position of the substituent is not specifically limited.

It is possible to use conventionally known hole transferring materials, that is, nitrogen-containing cyclic compounds and condensed polycyclic compounds, e.g. oxadiazole compounds such as 2,5-di(4-methylaminophenyl)-1,3,4-oxadiazol e, etc.; styryl compounds such as 9-(4-diethylaminostyryl)anthracene, etc.; carbazole compounds such as polyvinyl carbazole, etc.; organopolysilane compounds; pyrazoline compounds such as 1-phenyl-3-(p-dimethy laminophenyl)pyrazoline, etc.; hydrazone compounds; triphenylamine compounds; indole compounds; oxazole compounds; isoxazole compounds; thiazole compounds; thiadiazole compounds; imidazole compounds; pyrazole compounds; and triazole compounds, together with the above hole transferring materials (HT-1) to (HT-13) or in place of them.

In the present invention, these hole transferring materials may be used alone or in combination thereof. When using the hole transferring material having film forming properties, such as poly(vinylcarbazole), etc., a binding resin is not required necessarily.

Electron Transferring Material

As the electron transferring material used in the present invention, the diphenoquinone derivative represented by the above general formula (2), naphthoquinone derivative represented by the general formula (3) and diazanaphtho[2,3-b]fluorene derivatives represented by the general formulas (4) to (5) are preferred in view of the combination with the stilbene derivative (1) as the hole transferring material. In addition to these electron transferring materials (2) to (5), various compounds having high electron transferring capability, for example, compounds represented by the following general formulas (ET1) to (ET13):

(ET1)

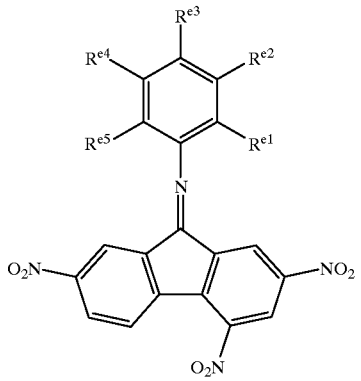

(wherein $R^{e1}$, $R^{e2}$, $R^{e3}$, $R^{e4}$ and $R^{e5}$ are the same or different and represent a hydrogen atom, an alkyl group which may have a substituent, an alkoxy group which may have a substituent, an aryl group which may have a substituent, an aralkyl group which may have a substitient, a phenoxy group which may have a substituent, or a halogen atom)

(ET2)

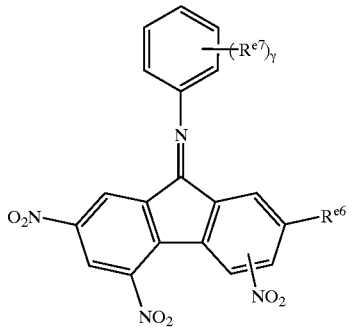

(wherein $R^{e6}$ represents an alkyl group; $R^{e7}$ represents an alkyl group which may have a substituent, an alkoxy group which may have a substituent, an aryl group which may have a substituent, an aralkyl group which may have a substitient, a halogen atom or a halogenated alkyl group; and γ represents an integer of 0 to 5, with the proviso that different groups may be substituted on the benzene ring when γ is 2 or more)

(ET3)

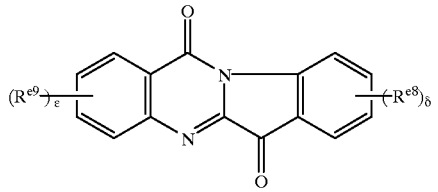

(wherein $R^{e8}$ and $R^{e9}$ may be the same or different and represent an alkyl group: δ represents an integer of 1 to 4; and ϵ represents an integer of 0 to 4, with the proviso that different groups may be substituted on the same benzene ring when δ and ϵ are 2 or more)

(ET4)

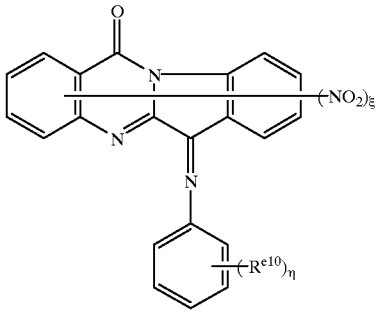

(wherein $R^{e10}$ represents an alkyl group, an aryl group, an aralkyl group, an alkoxy group, a halogenated alkyl group or a halogen atom; ζ represents an integer of 0 to 4; and η represents an integer of 0 to 5, with the proviso that different groups may be substituted on the benzene ring when η is 2 or more)

(ET5)

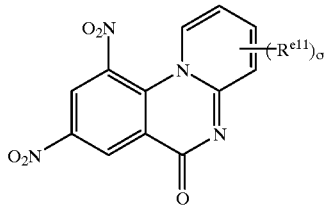

(wherein $R^{e11}$ represents an alkyl group; and &R represents an integer of 1 to 4, with the proviso that different groups may be substituted on the condensed ring when σ is 2 or more)

(ET6)

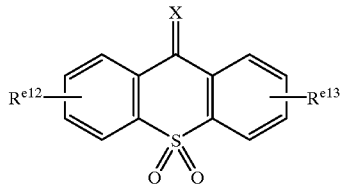

(wherein $R^{e12}$ and $R^{e13}$ are the same or different and represent a hydrogen atom, a halogen atom, an alkyl group, an aryl group, an aralkyloxycarbonyl group, an alkoxy group, a hydroxyl group, a nitro group or a cyano group; and X represents an oxygen atom, a ═N—CN group or a ═$C(CN)_2$ group)

(ET7)

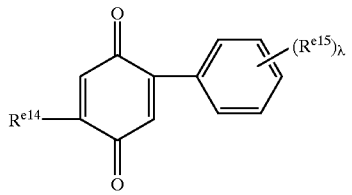

(wherein $R^{e14}$ represents a hydrogen atom, a halogen atom, an alkyl group or a phenyl group which may have a substituent; $R^{e15}$ represents a halogen atom, an alkyl group which may have a substituent, a phenyl group which may have a substituent, an alkoxycarbonyl group, a N-alkylcarbamoyl group, a cyano group or a nitro group; and λ represents an integer of 0 to 3, with the proviso that different groups may be substituted on the benzene ring when λ is 2 or more)

(ET8)

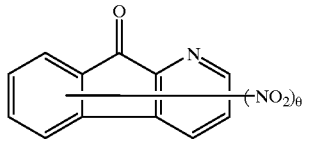

(wherein θ represents an integer of 1 to 2)

(ET9)

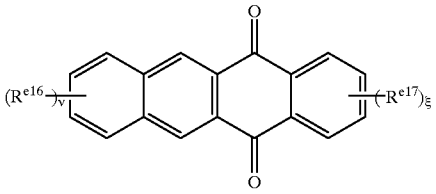

(wherein $R^{e16}$ and $R^{e17}$ are the same or different and represent a halogen atom, an alkyl group which may have a substituent, a cyano group, a nitro group or an alkoxycarbonyl group; and ν and ξ represent an integer of 0 to 3, with the proviso that different groups may be substituted on the same benzene ring when ν or ξ is 2 or more)

(ET10)

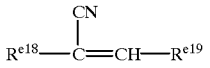

(wherein $R^{e18}$ and $R^{e19}$ are the same or different and represent a phenyl group, a polycyclic aromatic group or a heterocyclic group, and these groups may have a substituent)

(ET11)

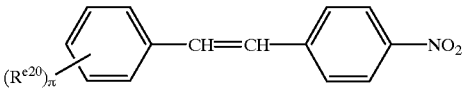

(wherein $R^{e20}$ represents an amino group, a dialkylamino group, an alkoxy group, an alkyl group or a phenyl group; and &P represents an integer of 1 to 2, with the proviso that different groups may be substituted on the benzene ring when π is 2)

(ET12)

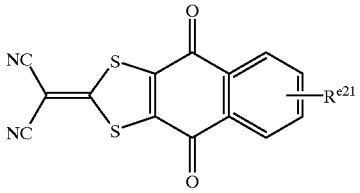

(wherein $R^{e21}$ represents a hydrogen atom, an alkyl group, an aryl group, an alkoxy group or an aralkyl group)

(ET13)

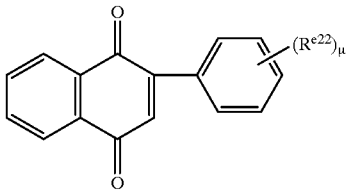

(wherein $R^{e22}$ represents a halogen atom, an alkyl group which may have a substituent, a phenyl group which may have a substituent, an alkoxycarbonyl group, a N-alkylcarbamoyl group, a cyano group or a nitro group; and &L represents an integer of 0 to 3, with the proviso that different groups may be substituted on the benzene ring when μ is 2 or more)

In the above electron transferring materials, examples of the alkyl group, alkoxy group, aryl group, aralkyl group, cycloalkyl group, halogenated alkyl group, alkoxycarbonyl group, heterocyclic group and halogen atom include the same groups as those described above.

Examples of the polycyclic aromatic group include naphthyl, phenanthryl, anthryl and the like. Examples of the aralkyloxycarbonyl group include those wherein the aralkyl moiety may be various aralkyl groups described above. Examples of the N-alkylcarbamoyl group include those wherein the alkyl moiety may be various aralkyl groups described above. Examples of the dialkylamino group include those wherein the alkyl moiety may be various alkyl groups described above. Incidentally, two alkyl groups substituted on amino may be the same or different.

Examples of the substituent, which may be substituted on the above alkyl group and alkoxy group, include halogen atom, amino group, hydroxyl group, optionally esterified carboxyl group, cyano group, alkoxy group having 1 to 6 carbon atoms, alkenyl having 2 to 6 carbon atoms which may have an aryl group and the like. The substitution position of the substituent is not specifically limited.

Examples of the substituent, which may be substituted on the above aryl group, aralkyl group and phenyl group, include halogen atom, amino group, hydroxyl group, optionally esterified carboxyl group, cyano group, alkyl group having 1 to 6 carbon atoms, alkoxy group having 1 to 6 carbon atoms, alkenyl having 2 to 6 carbon atoms which may have an aryl group and the like. The substitution position of the substituent is not specifically limited.

It is possible to use conventionally known electron transferring materials such as benzoquinone compound, malononitrile compound, thiopyran compound, tetracyanoethylene, 2,4,8-trinitrothioxanthone, dinitrobenzene, dinitroanthracene, dinitroacridine, nitroanthraquinone, succinic anhydride, maleic anhydride, dibromomaleic anhydride, etc., in addition to the above electron transferring materials (ET1) to (ET13).

In the present invention, these electron transferring materials may be used alone or in combination thereof.

Binding Resin

As the binding resin for dispersing the above respective components, there can be used various resins which have conventionally used in the photosensitive layer. Examples thereof include thermoplastic resins such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyarylate, polysulfon, diaryl phthalate resin, ketone resin, polyvinyl butyral resin, polyether resin, polyester resin and the like; crosslinking thermosetting resins such as silicone resin, epoxy resin, phenol resin, urea resin, melamine resin and the like; and photosetting resins such as epoxy acrylate, urethane acrylate and the like.

In addition to the above respective components, conventionally known various additives such as deterioration inhibitors (e.g. antioxidants, radical scavengers, singlet quenchers, ultraviolet absorbers, etc.), softeners, plasticizers, surface modifiers, bulking agents, thickening agents, dispersion stabilizers, wax, acceptors, donors and the like can be formulated in the photosensitive layer without injury to the electrophotographic characteristics. In order to improve the sensitivity of the photosensitive layer, known sensitizers such as terphenyl, halonaphthoquinones, acenaphthylene and the like may be used in combination with the electric charge generating material.

In the single-layer type photosensitive material, the electric charge generating material is formulated in the amount of 0.1 to 50 parts by weight, and preferably 0.5 to 30 parts by weight, based on 100 parts by weight of the binding resin. The stilbene derivative (1) (hole transferring material) of the present invention is formulated in the amount of 20 to 500 parts by weight, and preferably 30 to 200 parts by weight, based on 100 parts by weight of the binding resin. The amount of the electron transferring material is from 5 to 100 parts by weight, and preferably from 10 to 80 parts by weight, based on 100 parts by weight of the binding resin. The thickness of the photosensitive layer in the single-layer type photosensitive material is from 5 to 100 $\mu$m, and preferably from 10 to 50 $\mu$m.

In the single-layer type photosensitive material, a barrier layer may be formed between the conductive substrate and photosensitive layer in such a range as not to injure the characteristics of the photosensitive material. In addition, a protective layer may be formed on the surface of the photosensitive layer.

As the conductive substrate to be used in the electrophotosensitive material of the present invention, various materials having the conductivity can be used, and examples thereof include single metals such as aluminum, copper, tin, platinum, silver, vanadium, molybdenum, chromium, cadmium, titanium, nickel, palladium, indium, stainless steel, brass and the like; plastic materials vapor-deposited or laminated with the above metal; glass materials coated with aluminum iodide, tin oxide, indium oxide and the like.

The conductive substrate may be made in the form of a sheet or a drum according to the structure of the image forming device to be used. The substrate itself may have a conductivity or only the surface of the substrate may have a conductivity. It is preferred that the conductive substrate has sufficient mechanical strength when used.

When the above photosensitive layer is formed by the application method, the above electric charge generating material, electric charge transferring material and binding resin may be dispersed and mixed, together with a suitable solvent, by using a known method, for example, using a roll mill, a ball mill, an atriter, a paint shaker, a supersonic dispenser, etc. to prepare a dispersion, which is applied by using a known means and then allowed to dry.

As the solvent for preparing the coating solution, there can be used various organic solvents, and examples thereof include alcohols such as methanol, ethanol, isopropanol, butanol and the like; aliphatic hydrocarbons such as n-hexane, octane, cyclohexane and the like; aromatic hydrocarbons such as benzene, toluene, xylene and the like; halogenated hydrocarbons such as dichloromethane, dichloroethane, carbon tetrachloride, chlorobenzene and the like; ethers such as dimethyl ether, diethyl ether, tetrahydrofuran, ethylene glycol dimethyl ether, diethylene glycol dimethyl ether and the like; ketones such as acetone, methyl ethyl ketone, cyclohexanone and the like; esters such as ethyl acetate, methyl acetate and the like; dimethylformaldehyde, dimethylformamide, dimethyl sulfoxide, and the like. These solvents may be used alone or in combination thereof.

In order to improve the dispersibility of the electric charge transferring material and electric charge generating material as well as the smoothness of the surface of the photosensitive layer, there may be used surfactants, leveling agents or the like.

Industrial Applicability

As described above in detail, the electrophotosensitive material of the present invention has high sensitivity because the stilbene desrivative represented by the above general formula (1) and the electron transferring material are contained. The electrophotosensitive material can be applied to any of positive and negative charging types with a single construction because it is a single-layer type photosensitive material, and has an advantage such as excellent optical characteritics.

Accordingly, the electrophotosensitive material of the present invention has such a specific effect that it contributes to realization of high speed and high performance of various image forming devices such as electrostatic copying machine, laser beam printer and the like.

Examples

The following Synthesis Examples, Examples and Comparative Examples further illustrate the present invention in detail.

Synthesis of Stilbene Derivative

Reference Example 1 (synthesis of 4-isopropyltriphenylamine)

4-isopropylaniline (19.4 g, 143 mmol), iodobenzene (60 g, 249 mmol), anhydrous potassium carbonate (20 g, 145 mmol) and powdered copper (1 g, 16 mmol) were added in 150 ml of nitrobenzene, and the mixture was reacted under reflux for about 24 hours. After the completion of the reaction, the inorganic salt was removed and the solvent was distilled off. The resulting residue was purified by silica gel column chromatography (developing solvent: chloroform-hexane mixed solvent) to obtain 29.2 g of the titled compound (yield: 71%).

Reference Example 2 (synthesis of 4-isopropyl-4'-formyltriphenylamine)

4-isopropylaniline (28 g, 97 mmol) was dissolved in 300 ml of dimethylformamide (DMF) and phosphorous oxychloride (15 g, 98 mmol) was added, and then the mixture was reacted at 40° C. for one hour. After the completion of the reaction, the reaction solution was added to 300 ml of water and extracted with ethyl acetate. The organic layer was washed with water and dried to remove the solvent, and then the residue was purified by silica gel column chromatography (developing solvent: chloroform-hexane mixed solvent) to obtain 26.7 g of the titled compound (yield: 87%).

Reference Example 3 (synthesis of 3,4-dimethyltriphenylamine)

According to the same manner as that described in Reference Example 1 except for using 3,4-xylidine (17.4 g, 144 mmol) in place of 4-isopropylaniline, the reaction and purification were conducted to obtain 29.4 g of the titled compound (yiled: 75%).

Reference Example 4 (synthesis of 3,4-dimethyl-4'-for myltriphenylamine)

According to the same manner as that described in Reference Example 2 except for using 3,4-dimethyltriphenylamine in place of 4-isopropyltriphenylamine, the reaction and purification were conducted to obtain 25.2 g of the titled compound (yield: 88%).

Reference Example 5 (synthesis of 3,3'-dimethyl-4"-et hyltriphenylamine)

According to the same manner as that described in Reference Example 1 except for using p-ethylaniline (17.4 g, 144 mmol) in place of 4-isopropylaniline and using m-iodotoluene (64 g, 294 mmol) in place of iodobenzene, the reaction and purification were conducted to obtain 29.4 g of the titled compound (yield: 68%).

Reference Example 6 (synthesis of 3,3'-dimethyl-4"-et hyl-4-formyltriphenylamine)

According to the same manner as that described in Reference Example 2 except for using 3,3'-dimethyl-4"-ethyltr iphenylamine in place of 4-isopropyltriphenylamine, the reaction and purification were conducted to obtain 29.4 g of the titled compound (yield: 93%).

Reference 7 (synthesis of bisphosphate)

A bisphosphate derivative represented by the following formula (94p) was obtained from triethyl phosphate and p-xylylene dichloride. Furthermore, a bisphosphate derivative represented by the following formula (94m) was obtained from triethyl phosphate and m-xylylene dichloride.

(94p)

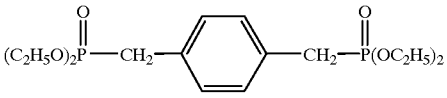

(94m)

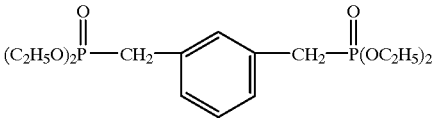

Synthesis Example 1 (synthesis of stilbene derivative (11-9) )

Bisphosphate (5 g, 13.2 mmol) represented by the above formula (94p) and sodium hydride dried under deaeration (1.1 g, 27.5 mmol) were added in 250 ml of tetrahydrofuran, followed by ice-cooling. To this mixture, a solution obtained by dissolving 4-isopropyl-4'-formyltriphenylamine (8.4 g, 26.6 mmol) in 50 ml of tetrahydrofuran was added dropwise and the reaction was performed at room temperature for about 3 hours. After the completion of the reaction, the reaction solution was added to 400 ml of an aqueous diluted hydrochloric acid solution (about 2%). The deposited crystal was collected by filtration, and then washed with water. The crystal was dried and purified by silica gel column chromatography (developing solvent: chloroform-hexane mixed solvent) to obtain 6.6 g of a stilbene derivative represented by the compound number 11-9 in the above Table 1 (yield: 71%)

Melting point: 120–122° C.

Figure 2:
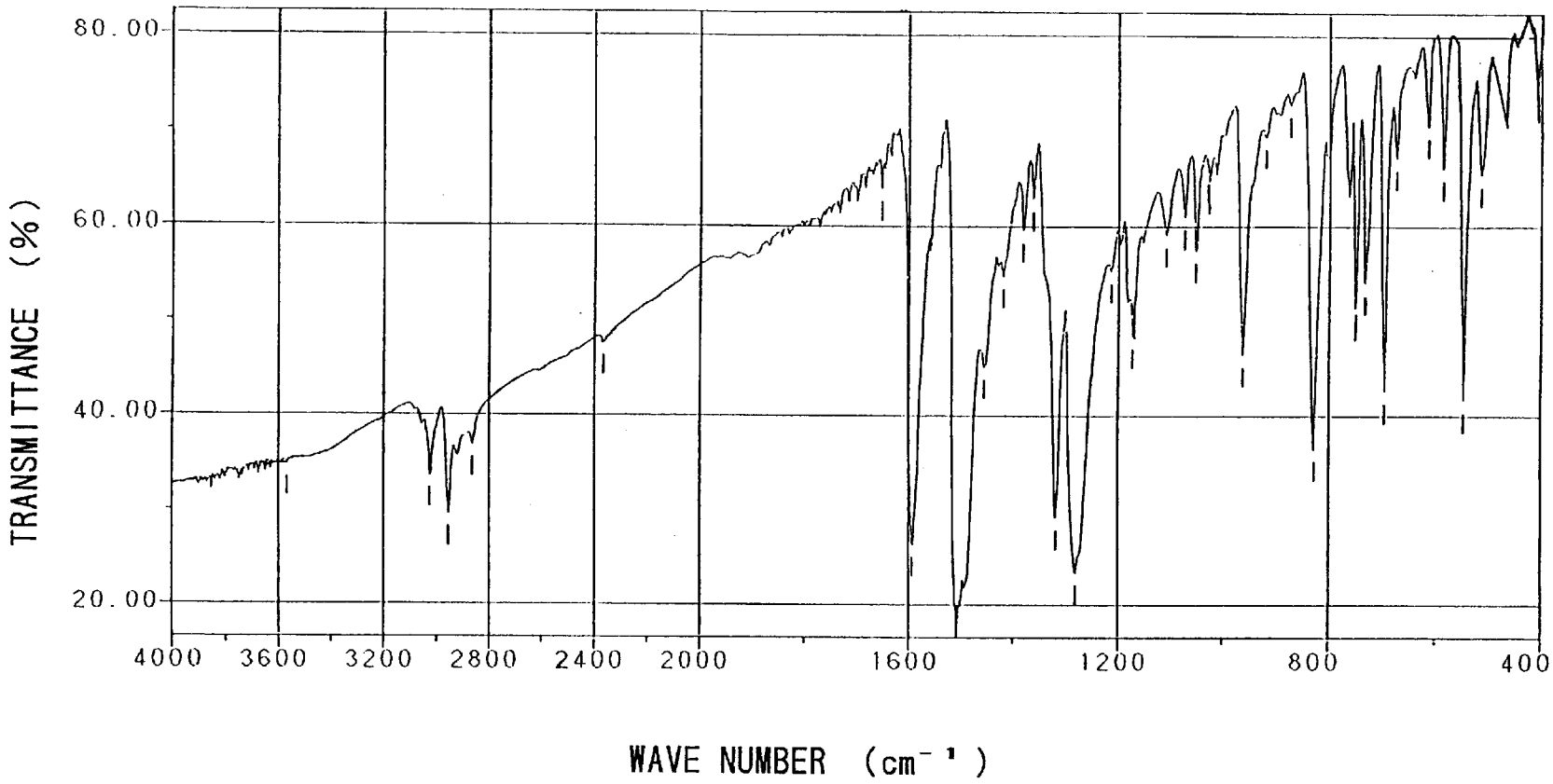
FIG. 2 is a graph illustrating an IR spectrum of the stilbene derivative (11-9).

The $^1$H-NMR spectrum of the above stilbene derivative (11-9) is shown in FIG. 1 and the IR (infrared absorption) spectrum is shown in FIG. 2.

Synthesis Example 2 (synthesis of stilbene derivative (12-9))

According to the same manner as that described in Synthesis Example 1 except for using 5 g of bisphosphate represented by the above formula (94m) in place of bisphosphate represented by the above formula (94p), the reaction and purification were performed to obtain 5.4 g of a stilbene derivative represented by the compound number 12-9 in the above Table 1 (yield: 58%)

Melting point: 94–96° C.

Figure 3:
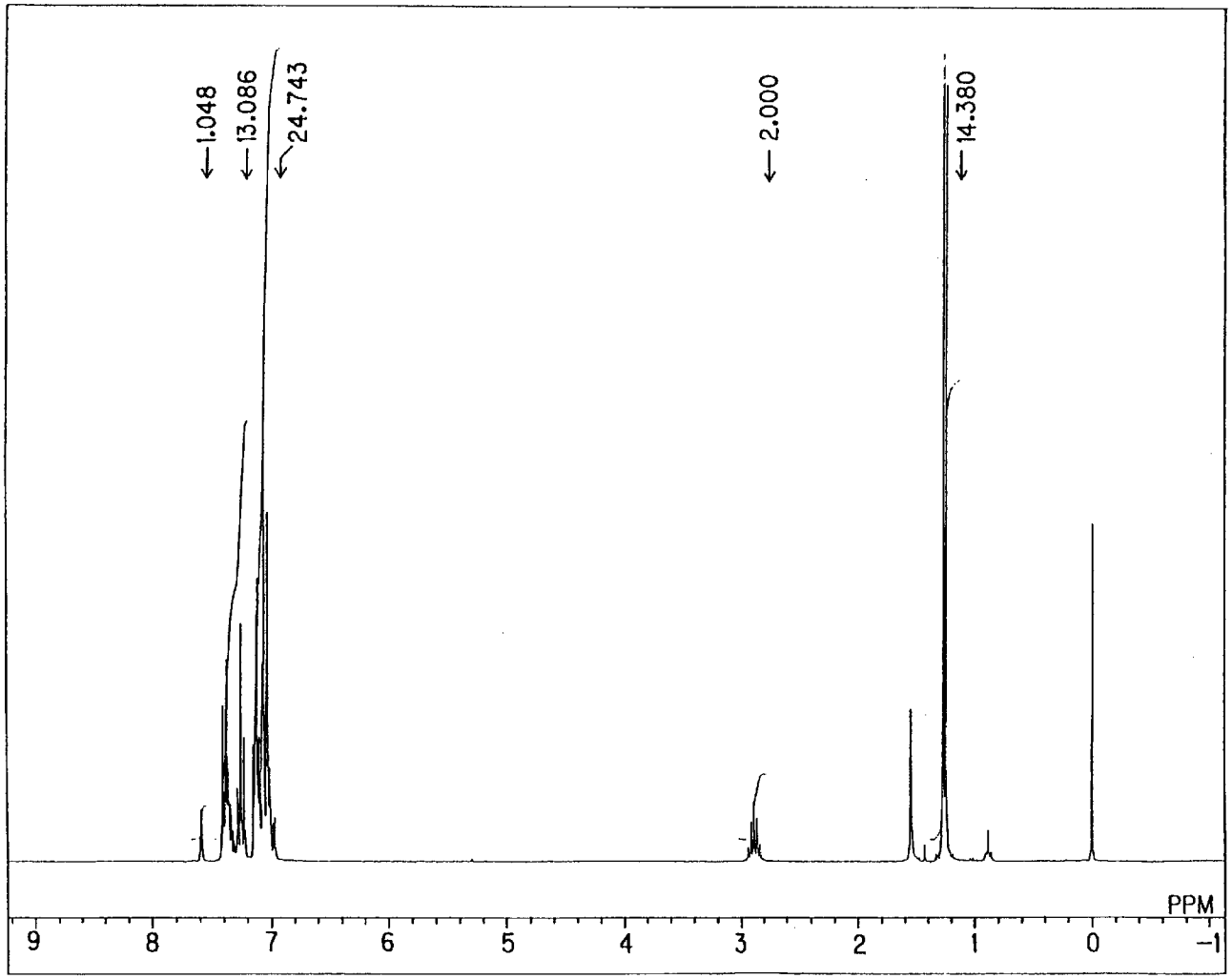
FIG. 3 is a graph illustrating a $^1$H-NMR spectrum of the stilbene derivative (12-9).
Figure 4:
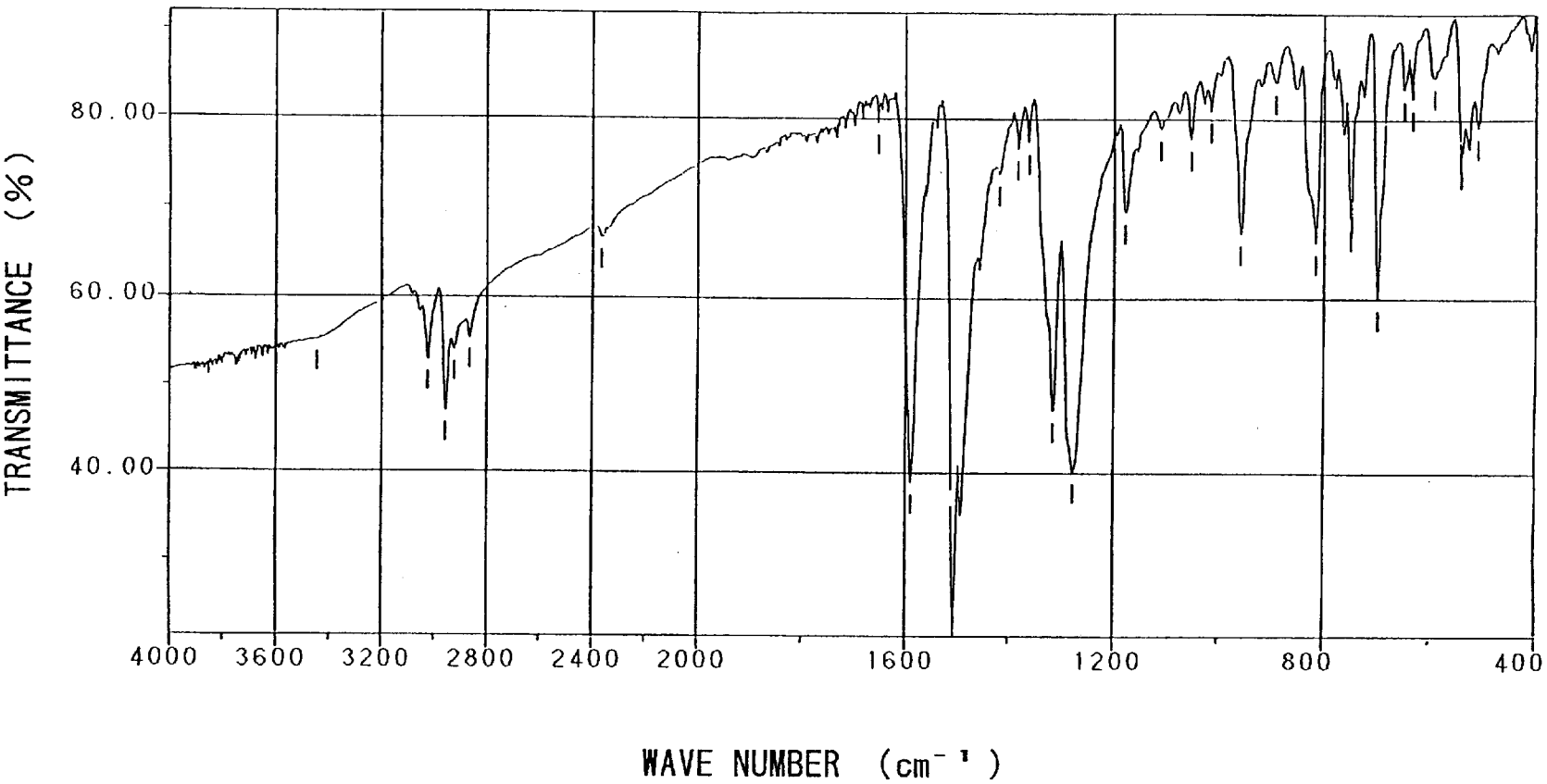
FIG. 4 is a graph illustrating an IR spectrum of the stilbene derivative (12-9).

The $^1$H-NMR spectrum of the above stilbene derivative (12-9) is shown in FIG. 3 and the IR spectrum is shown in FIG. 4.

Synthesis Example 3 (synthesis of stilbene derivative (11-7))

According to the same manner as that described in Synthesis Example 3 except for using 3,4-dimethyl-4'-formyltr iphenylamine (8 g, 26.5 mmol) in place of 4-isopropyl-4'-formyltriphenylamine, the reaction and purification were performed to obtain 6.7 g of a stilbene derivative represented by the compound number 11-7 in the above Table 2 (yield: 75%)

Melting point: 195–197° C.

Figure 5:
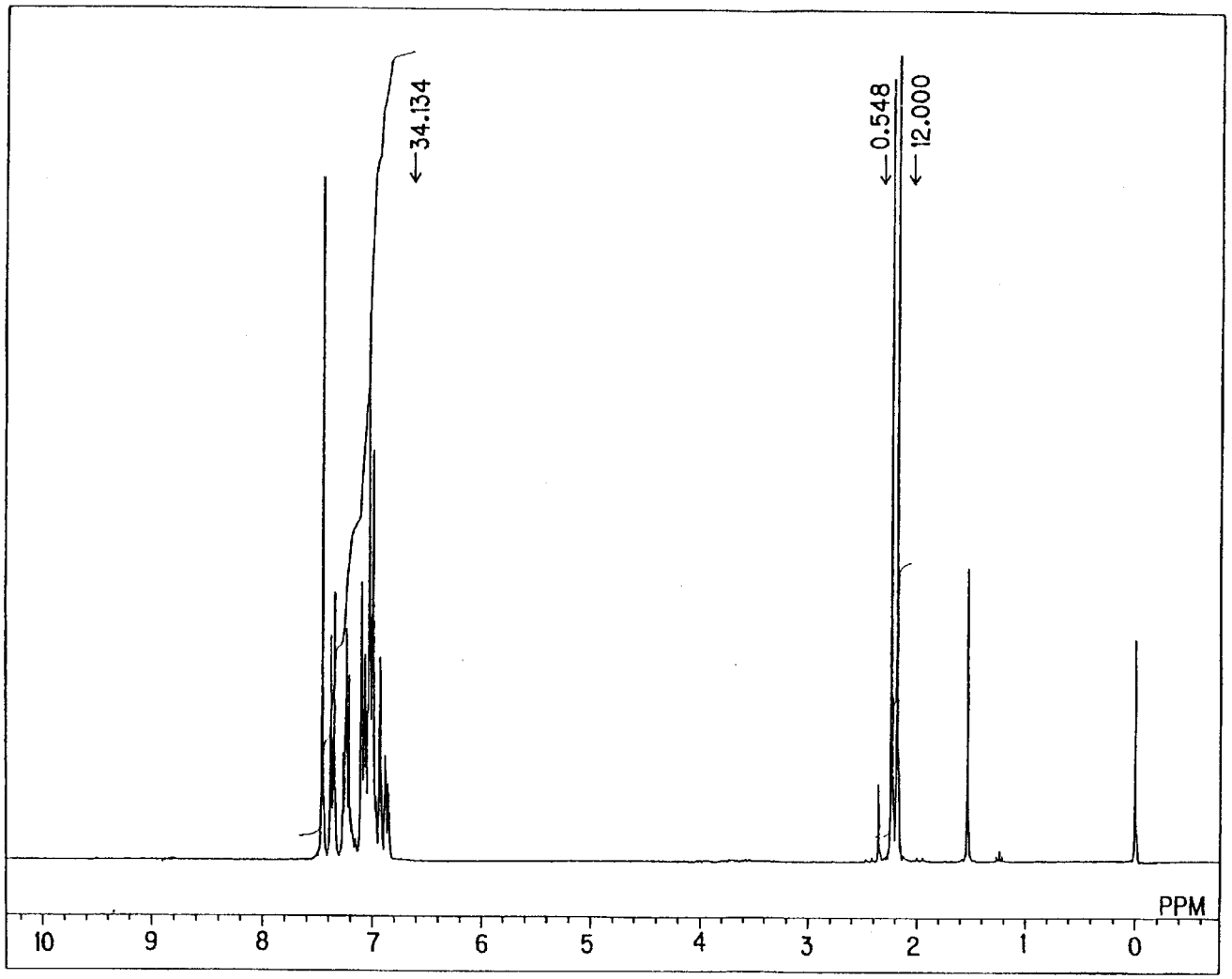
FIG. 5 is a graph illustrating a $^1$H-NMR spectrum of the stilbene derivative (11-17).
Figure 6:
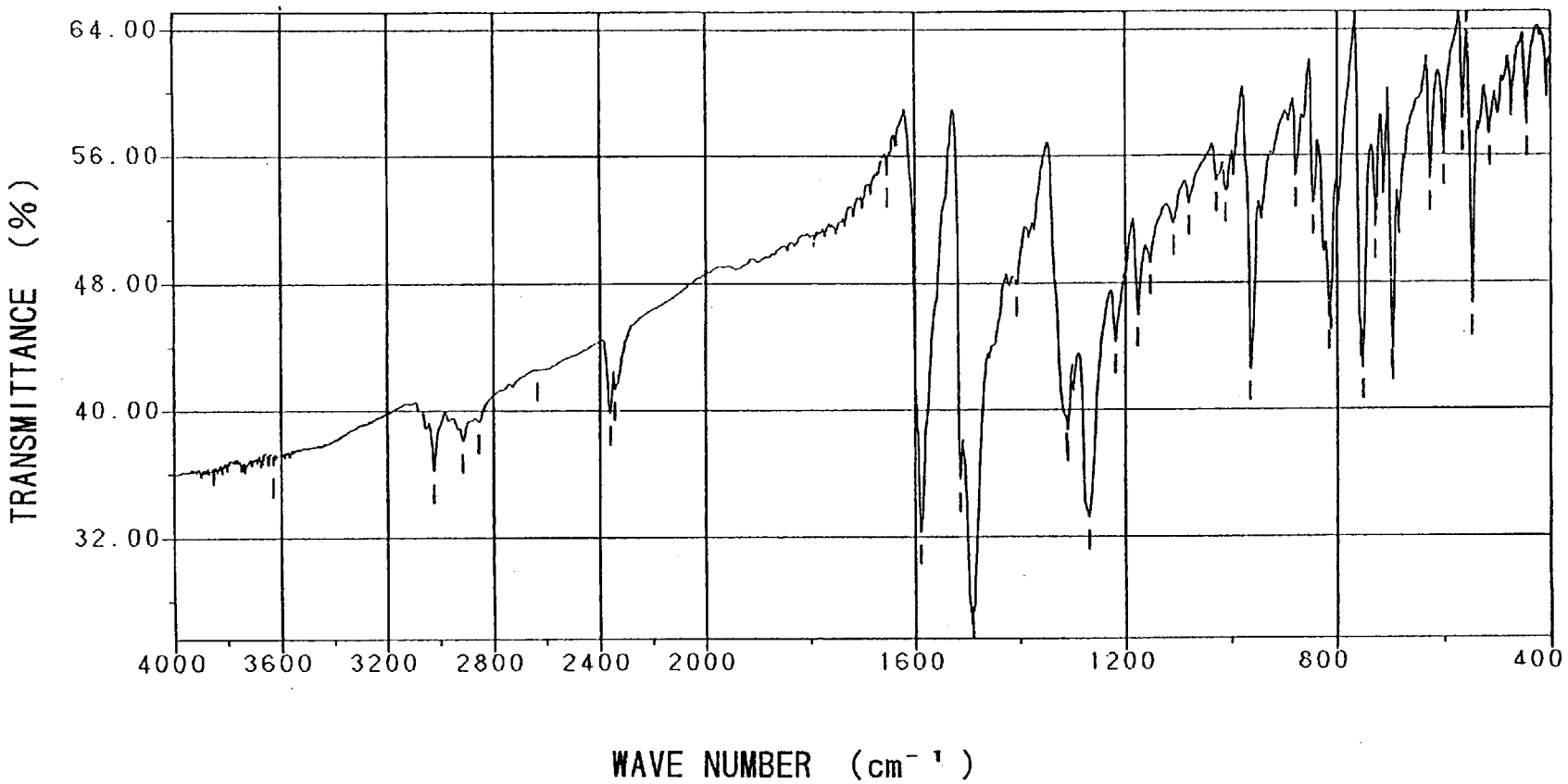
FIG. 6 is a graph illustrating an IR spectrum of the stilbene derivative (11-17).

The $^1$H-NMR spectrum of the above stilbene derivative (11-7) is shown in FIG. 5 and the IR spectrum is shown in FIG. 6.

Synthesis Example 4 (synthesis of stilbene derivative (12-17))

According to the same manner as that described in Synthesis Example 1 except for using 5 g of bisphosphate represented by the above formula (94m) in place of bisphosphate represented by the above general formula (94p), the reaction and purification were performed to obtain 4.6 g of a stilbene derivative represented by the compound number 12-17 in the above Table 2 (yield: 52%)

Melting point: 88–90° C.

Figure 7:
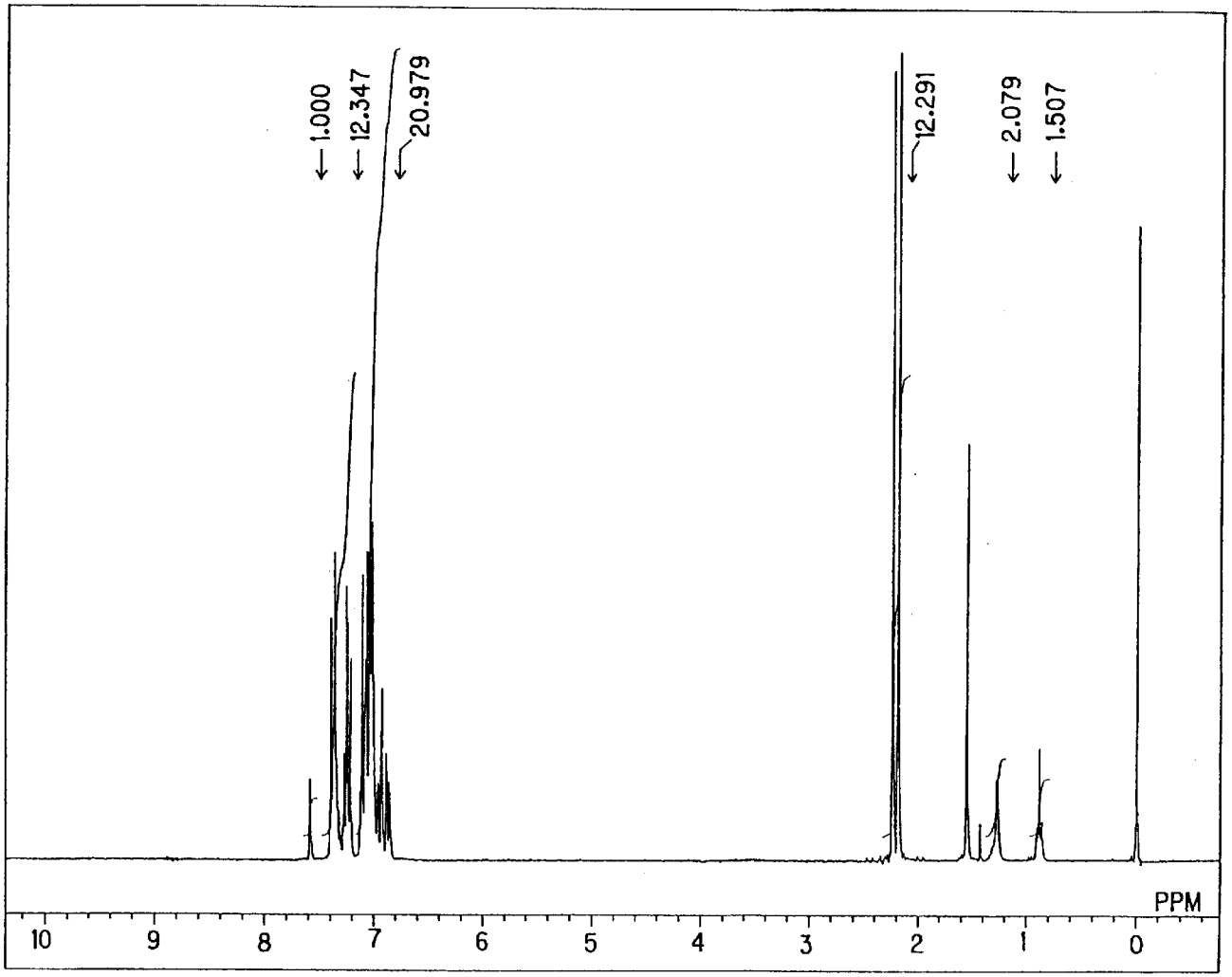
FIG. 7 is a graph illustrating a $^1$H-NMR spectrum of the stilbene derivative (12-17).
Figure 8:
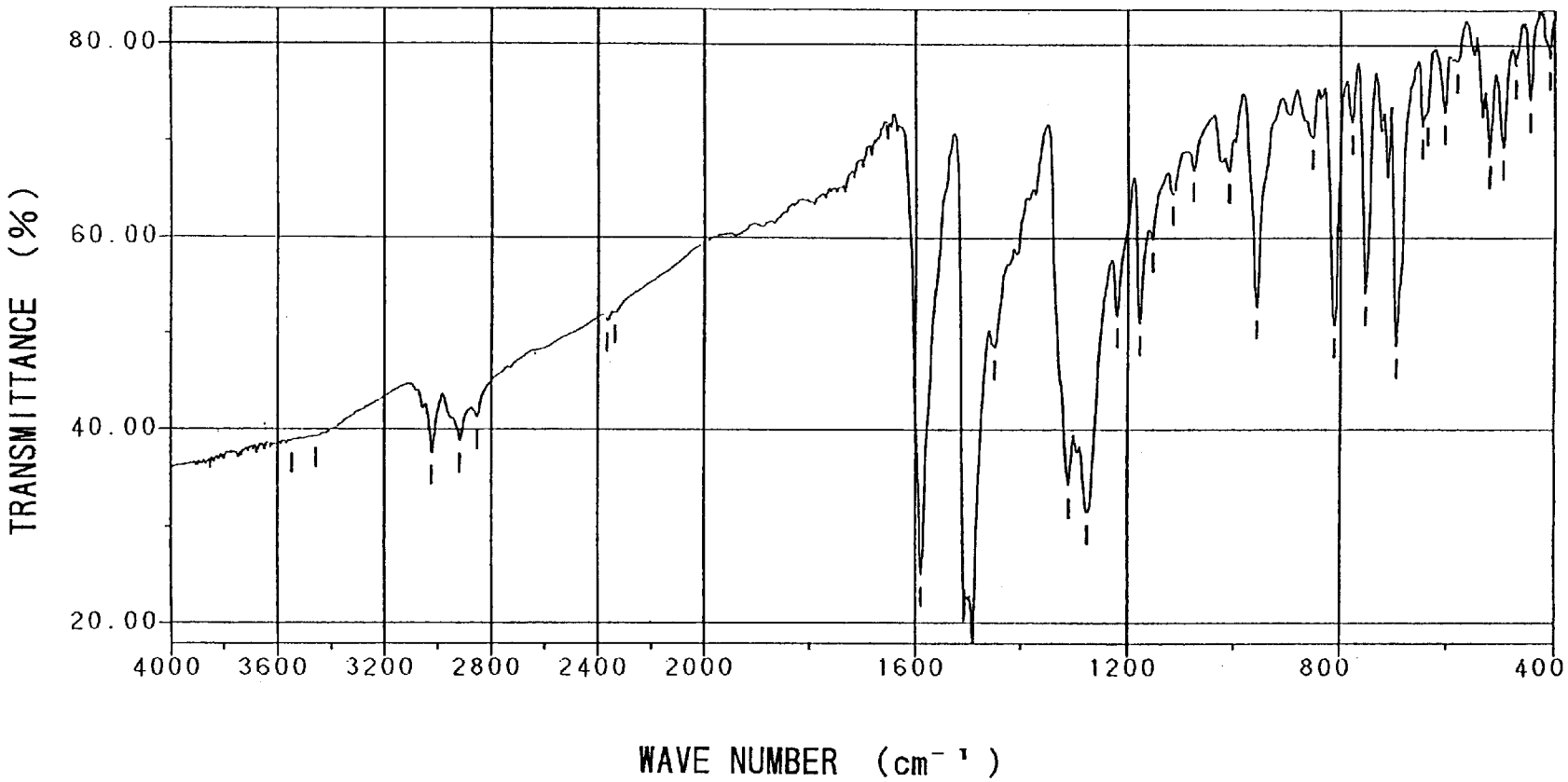
FIG. 8 is a graph illustrating an IR spectrum of the stilbene derivative (12-17).

The $^1$H-NMR spectrum of the above stilbene derivative (12-17) is shown in FIG. 7 and the IR spectrum is shown in FIG. 8.

Synthesis Example 5 (synthesis of stilbene derivative (11-8))

According to the same manner as that described in Synthesis Example 1 except for using 4-ethyl-3',3"-dimethyl-4'-formyltriphenylamine (8.7 g, 26.4 mmol) in place of 4-isopropyl-4'-formyltriphenylamine, the reaction and purification were performed to obtain 6.5 g of a stilbene derivative represented by the compound number 11-8 in the above Table 1 (yield: 68%)

Melting point: 194–196° C.

Figure 9:
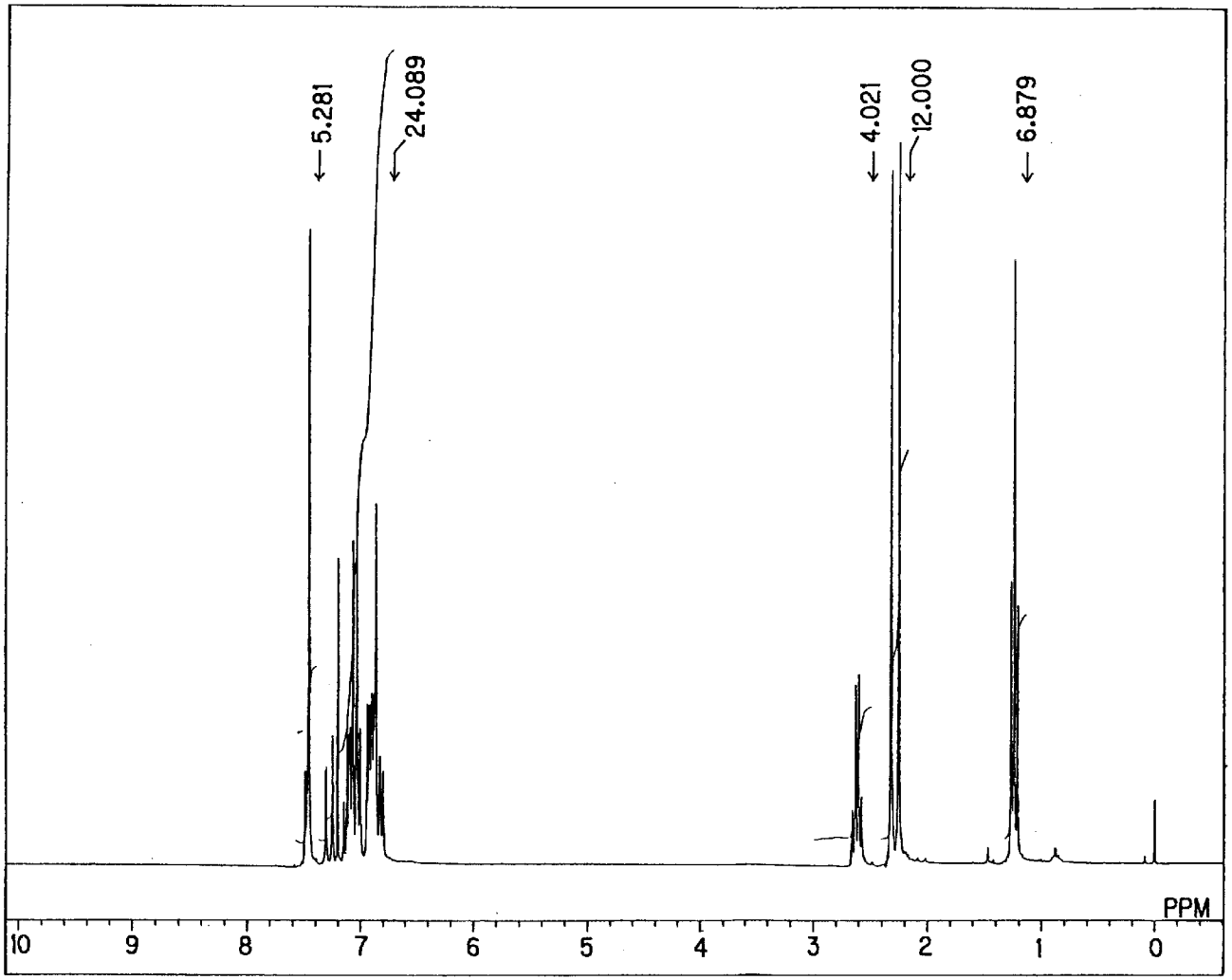
FIG. 9 is a graph illustrating a $^1$H-NMR spectrum of the stilbene derivative (11-8).
Figure 10:
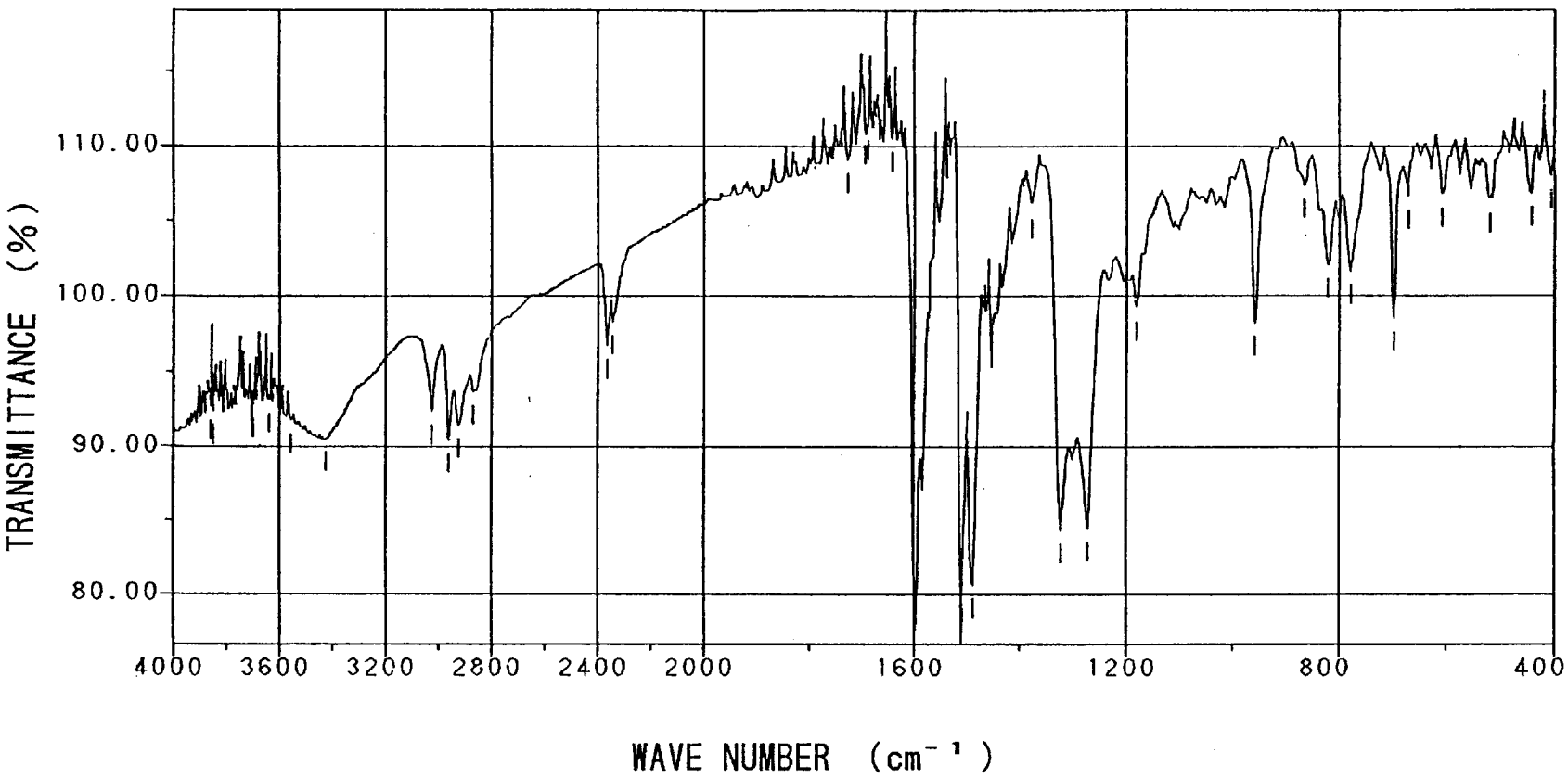
FIG. 10 is a graph illustrating an IR spectrum of the stilbene derivative (11-8).

The $^1$H-NMR spectrum of the above stilbene derivative (11-8) is shown in FIG. 9 and the IR spectrum is shown in FIG. 10.

Synthesis Example 6 (synthesis of stilbene derivative (12-8))

According to the same manner as that described in Synthesis Example 5 except for using 5 g of bisphosphate represented by the above formula (94m) in place of bisphosphate represented by the above general formula (94p), the reaction and purification were performed to obtain 5.2 g of a stilbene derivative represented by the compound number 12-8 in the above Table 1 (yield: 54%)

Melting point: 94–96° C.

Figure 11:
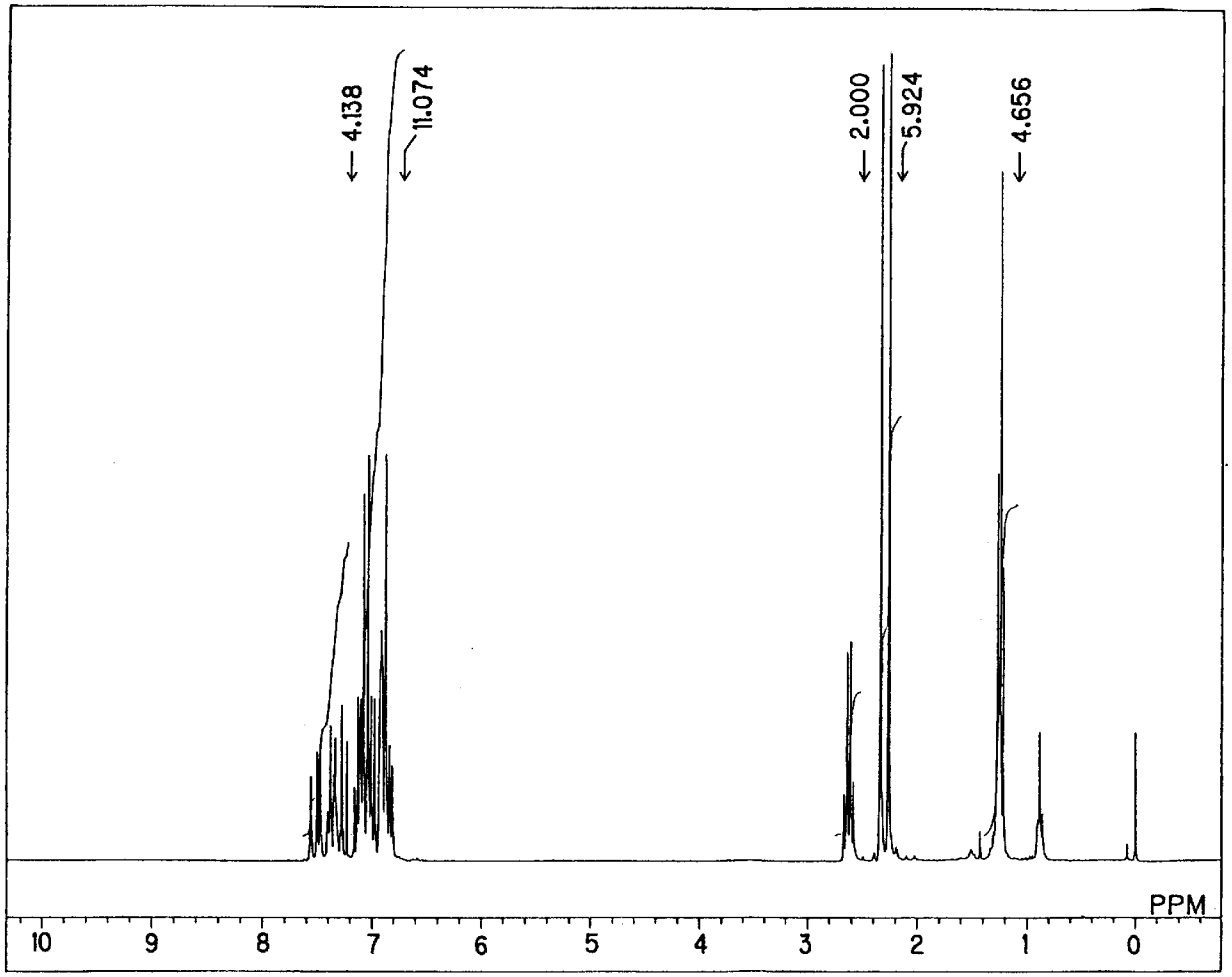
FIG. 11 is a graph illustrating a $^1$H-NMR spectrum of the stilbene derivative (12-8).
Figure 12:
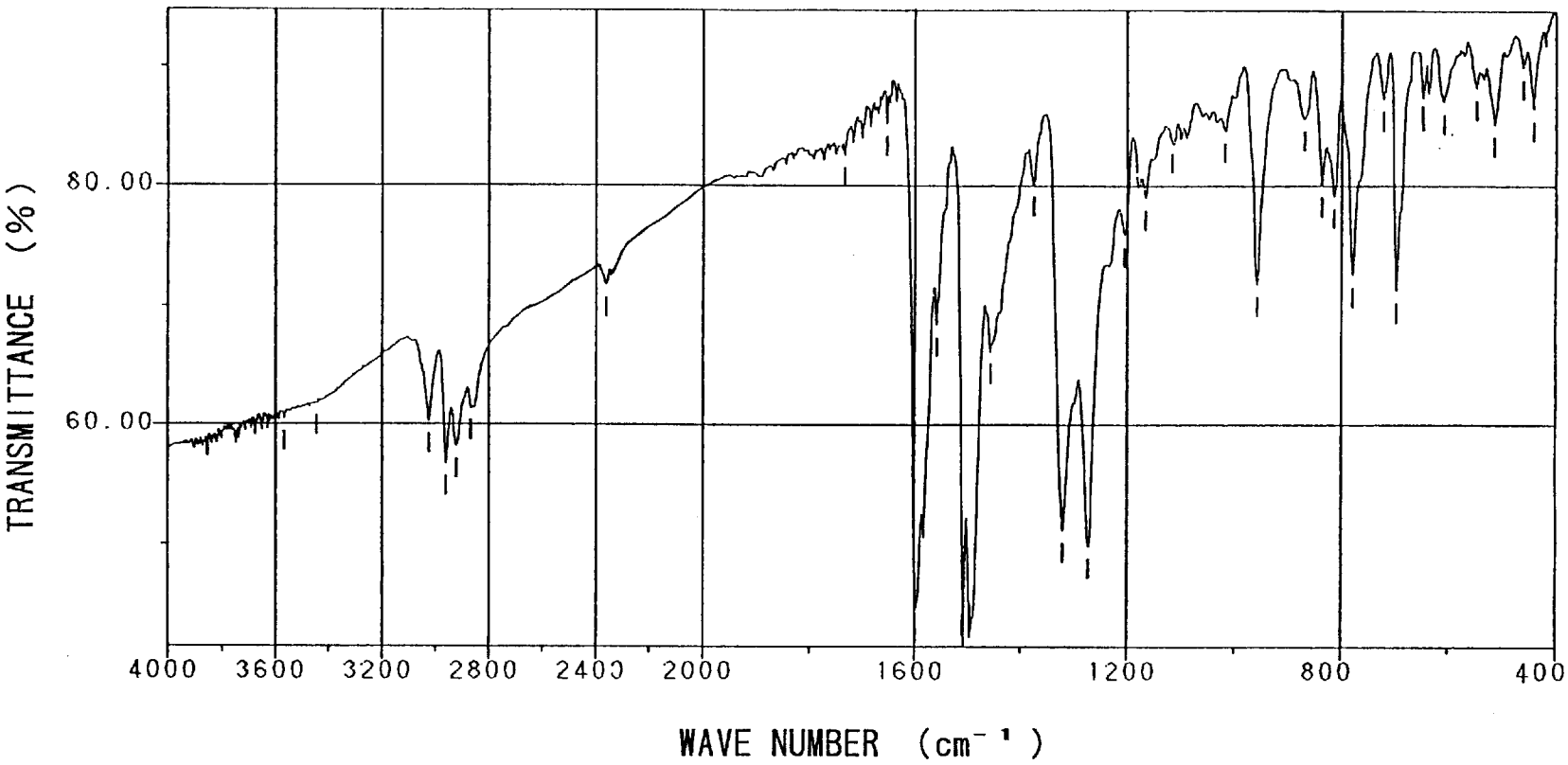
FIG. 12 is a graph illustrating an IR spectrum of the stilbene derivative (12-8).

The $^1$H-NMR spectrum of the above stilbene derivative (12-8) is shown in FIG. 11 and the IR spectrum is shown in FIG. 12.

Synthesis Example 7 (synthesis of stilbene derivative (12-1))

According to the same manner as that described in Synthesis Example 2 except for using 4-methyl-4'-formyltriphenylamine (7.6 g, 26.4 mmol) in place of 4-isopropyl-4'-formyltriphenylamine, the reaction and purification were performed to obtain 7.0 g of a stilbene derivative represented by the compound number 12-1 in the above Table 1 (yield: 82%)

Melting point: 196–198° C.

Production of Electrophotosensitive Material (Single-layer type photosensitive material for digital light source)

Example 1

A X type metal-free phthalocyanine (CGl-1) was used as the electric charge generating material. A stilbene derivative represented by the compound number 12-1 of the above Table 1 was used as the hole transferring material. As the electron transferring material, a diphenoquinone derivative represented by the formula (2-1):

(2-1)

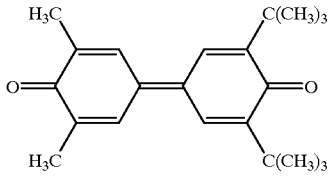

was used.

5 Parts by weight of the above electric charge generating material, 100 parts by weight of the above hole transferring material, 30 parts by weight of the above electron transferring material and 100 parts by weight of a binding resin (polycarbonate) were mixed and dispersed, together with 800 parts by weight of a solvent (tetrahydrofuran), in a ball mill for 50 hours to prepare a coating solution for single-layer type photosensitive layer. Then, this coating solution was applied on a conductive substrate (aluminum tube) by using the dip coating method, followed by hot-air drying at 100° C. for 30 minutes to obtain a single-layer type photosensitive material for digital light source, which has a single-layer type photosensitive layer of 25 $\mu$m in film thickness.

Example 2

According to the same manner as that described in Example 1 except for using a stilbene derivative represented by the compound number (11-6) of the above Table 1 as the hole transferring material, a single-layer type photosensitive material for digital light source was produced.

Example 3

According to the same manner as that described in Example 1 except for using a stilbene derivative represented by the compound number 11-9 of the above Table 1 as the hole transferring material, a single-layer type photosensitive material for digital light source was produced.

Example 4

According to the same manner as that described in Example 1 except for using a stilbene derivative represented by the compound number 12-17 of the above Table 1 as the hole transferring material, a single-layer type photosensitive material for digital light source was produced.

Example 5

According to the same manner as that described in Example 1 except for using a stilbene derivative represented by the compound number 11-17 of the above Table 1 as the hole transferring material, a single-layer type photosensitive material for digital light source was produced.

Examples 6 to 10

According to the same manner as that described in Examples 1 to 5 except for using a naphthoquione derivative represented by the formula (3-1):

(3-1)

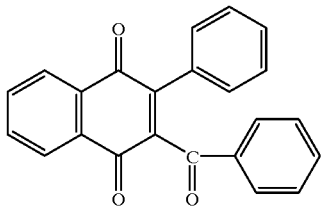

as the electron transferring material, single-layer type photosensitive materials for digital light source were produced, respectively.

Examples 11 to 13

According to the same manner as that described in Examples 1 to 3 except for using a naphthoquinone derivative represented by the formula (3-2):

(3-2)

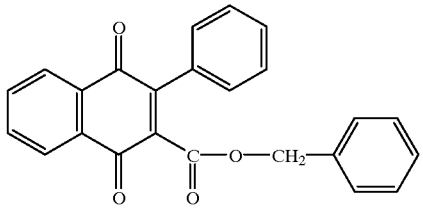

as the electron transferring material, single-layer type photosensitive materials for digital light source were produced, respectively.

Examples 14 to 16

According to the same manner as that described in Examples 1 to 3 except for using a diazanaphtho[2,3-b] fluorene derivative represented by the formula (4-1):

(4-1)

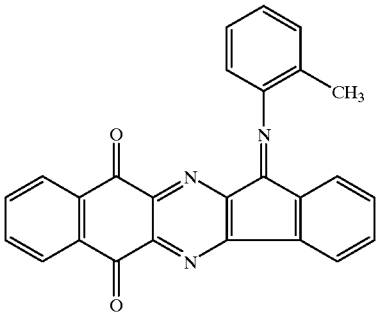

as the electron transferring material, single-layer type photosensitive materials for digital light source were produced, respectively.

Comparative Example 1

According to the same manner as that described in Example 1 except for using a stilbene derivative represented by the formula (6-1):

(6-1)

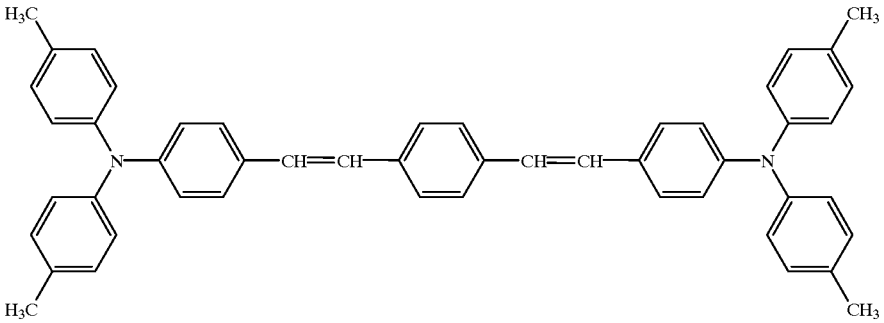

as the hole transferring material, a single-layer type photosensitive material for digital light source was produced.

Comparative Example 2

According to the same manner as that described in Example 1 except for using a stilbene derivative represented by the formula (6-2):

(6-2)

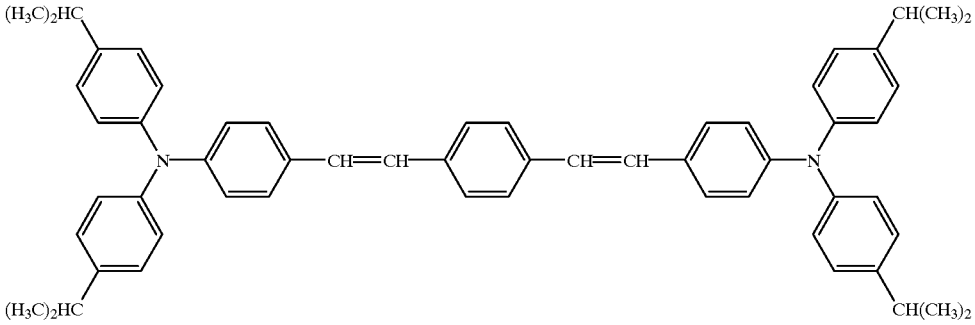

as the hole transferring material, a single-layer type photosensitive material for digital light source was produced.

Comparative Example 3

According to the same manner as that described in Example 1 except for using a stilbene derivative represented by the formula (6-3):

(6-3)

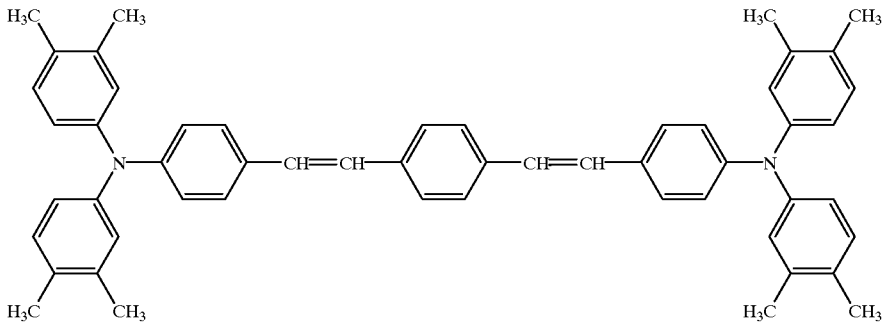

as the hole transferring material, a single-layer type photosensitive material for digital light source was produced.

The photosensitive materials obtained in Examples 1 to 16 and Comparative Examples 1 to 3 were subjected to the following electrical characteristics test (I) and the electrical characteristics of the respective photosensitive materials were evaluated, respectively.

Electrical Characteristic Test (I)

By using a drum sensitivity tester manufactured by GENTEC Co., a voltage was applied on the surface of each photosensitive material to charge the surface at +700 V±20 V and the surface potential ($V_0$) was measured. Then, monochromatic light [wavelength: 780 nm (half-width: 20 nm), light intensity: 8 $\mu$J/cm$^2$] from white light of a halogen lamp as an exposure light source through a band-pass filter was irradiated on the surface of each photosensitive material (irradiation time: 1.5 sec.) and the time required to reduce the above surface potential $V_0$ to half was measured and a half-time exposure $E_{1/2}$ ($\mu$J/cm$^2$) was calculated. Furthermore, a surface potential at the time at which 0.5 sec. has passed since the beginning of exposure was measured as a residual potential $V_r$ (V).

The kind of the electric charge generating material, hole transferring material and electron transferring material used in the above respective Examples and Comparative Examples as well as test results of the electrical characteristics are shown in Table 5. In the following tables, the electric charge generating material, hole transferring material and electron transferring material were represented by each formula number or each compound number.

TABLE 5

| | CGM | HTM | ETM | $V_o$ | $V_r$ | $E_{1/2}$ |
|---|---|---|---|---|---|---|
| EX. 1 | CG1-1 | 12-1 | 2-1 | 703 | 97 | 0.68 |
| EX. 2 | CG1-1 | 12-8 | 2-1 | 698 | 110 | 0.66 |
| EX. 3 | CG1-1 | 11-9 | 2-1 | 704 | 97 | 0.66 |
| EX. 4 | CG1-1 | 12-17 | 2-1 | 699 | 98 | 0.67 |
| EX. 5 | CG1-1 | 11-17 | 2-1 | 697 | 96 | 0.65 |

TABLE 5-continued

| | CGM | HTM | ETM | $V_o$ | $V_r$ | $E_{1/2}$ |
|---|---|---|---|---|---|---|
| EX. 6 | CG1-1 | 12-1 | 3-1 | 701 | 98 | 0.67 |
| EX. 7 | CG1-1 | 12-8 | 3-1 | 705 | 110 | 0.64 |

TABLE 5-continued

| | CGM | HTM | ETM | $V_o$ | $V_r$ | $E_{1/2}$ |
|---|---|---|---|---|---|---|
| EX. 8 | CG1-1 | 11-9 | 3-1 | 697 | 94 | 0.64 |
| EX. 9 | CG1-1 | 12-17 | 3-1 | 697 | 99 | 0.69 |
| EX. 10 | CG1-1 | 11-17 | 3-1 | 703 | 95 | 0.65 |
| EX. 11 | CG1-1 | 12-1 | 3-2 | 700 | 94 | 0.66 |
| EX. 12 | CG1-1 | 12-8 | 3-2 | 702 | 110 | 0.66 |
| EX. 13 | CG1-1 | 11-9 | 3-2 | 696 | 97 | 0.68 |
| EX. 14 | CG1-1 | 12-1 | 4-1 | 697 | 98 | 0.68 |
| EX. 15 | CG1-1 | 12-8 | 4-1 | 701 | 112 | 0.69 |
| EX. 16 | CG1-1 | 11-9 | 4-1 | 698 | 96 | 0.64 |
| COMP. EX. 1 | CG1-1 | 6-1 | — | 703 | 163 | 0.99 |
| COMP. EX. 2 | CG1-1 | 6-2 | — | 697 | 159 | 1.09 |
| COMP. EX. 3 | CG1-1 | 6-3 | — | 701 | 160 | 1.09 |

Examples 17 to 21

According to the same manner as that described in Examples 1 to 5 except for using an α type oxotitanylphthalocyanine (CG2-1) as the electric charge generating material, single-layer type photosensitive materials for digital light source were produced, respectively.

Examples 22 to 26

According to the same manner as that described in Examples 6 to 10 except for using an α type oxotitanylphthalocyanine (CG2-1) as the electric charge generating material, single-layer type photosensitive materials for digital light source were produced, respectively.

Examples 27 to 29

According to the same manner as that described in Examples 11 to 13 except for using an α type oxotitanylphthalocyanine (CG2-1) as the electric charge generating material, single-layer type photosensitive materials for digital light source were produced, respectively.

Examples 30 to 32

According to the same manner as that described in Examples 14 to 16 except for using an α type oxotitanylphthalocyanine (CG2-1) as the electric charge generating material, single-layer type photosensitive materials for digital light source were produced, respectively.

Comparative Examples 4 to 6

According to the same manner as that described in Comparative Examples 1 to 3 except for using an α type oxotitanylphthalocyanine (CG2-1) as the electric charge generating material, single-layer type photosensitive materials for digital light source were produced, respectively.

The photosensitive materials obtained in Examples 17 to 32 and Comparative Examples 4 to 6 were subjected to the above electrical characteristics test (I) and the electrical characteristics of the respective photosensitive materials were evaluated, respectively. The kind of the electric charge generating material, hole transferring material and electron transferring material used in the above respective Examples and Comparative Examples as well as test results of the electrical characteristics are shown in Table 6.

TABLE 6

| | CGM | HTM | ETM | $V_o$ | $V_r$ | $E_{1/2}$ |
|---|---|---|---|---|---|---|
| EX. 17 | CG2-1 | 12-1 | 2-1 | 701 | 90 | 0.65 |
| EX. 18 | CG2-1 | 12-8 | 2-1 | 694 | 110 | 0.66 |
| EX. 19 | CG2-1 | 11-9 | 2-1 | 698 | 94 | 0.67 |
| EX. 20 | CG2-1 | 12-17 | 2-1 | 698 | 90 | 0.70 |
| EX. 21 | CG2-1 | 11-17 | 2-1 | 701 | 93 | 0.69 |
| EX. 22 | CG2-1 | 12-1 | 3-1 | 690 | 96 | 0.63 |
| EX. 23 | CG2-1 | 12-8 | 3-1 | 702 | 118 | 0.68 |
| EX. 24 | CG2-1 | 11-9 | 3-1 | 701 | 94 | 0.67 |
| EX. 25 | CG2-1 | 12-17 | 3-1 | 695 | 93 | 0.69 |
| EX. 26 | CG2-1 | 11-17 | 3-1 | 705 | 92 | 0.65 |
| EX. 27 | GG2-1 | 12-1 | 3-2 | 691 | 95 | 0.63 |
| EX. 28 | CG2-1 | 12-8 | 3-2 | 699 | 110 | 0.64 |
| EX. 29 | CG2-1 | 11-9 | 3-2 | 700 | 92 | 0.67 |
| EX. 30 | CG2-1 | 12-1 | 4-1 | 705 | 98 | 0.66 |
| EX. 31 | CG2-1 | 12-8 | 4-1 | 697 | 105 | 0.68 |
| EX. 32 | CG2-1 | 11-9 | 4-1 | 700 | 98 | 0.69 |
| COMP. EX. 4 | CG2-1 | 6-1 | — | 702 | 150 | 1.01 |
| COMP. EX. 5 | CG2-1 | 6-2 | — | 702 | 148 | 1.10 |
| COMP. EX. 6 | CG2-1 | 6-3 | — | 705 | 149 | 1.08 |

Examples 33 to 37

According to the same manner as that described in Examples 1 to 5 except for using a Y type oxotitanylphthalocyanine (CG2-2) as the electric charge generating material, single-layer type photosensitive materials for digital light source were produced, respectively.

Examples 38 to 42

According to the same manner as that described in Examples 6 to 10 except for using a Y type oxotitanylphthalocyanine (CG2-2) as the electric charge generating material, single-layer type photosensitive materials for digital light source were produced, respectively.

Examples 43 to 45

According to the same manner as that described in Examples 11 to 13 except for using a Y type oxotitanylphthalocyanine (CG2-2) as the electric charge generating material, single-layer type photosensitive materials for digital light source were produced, respectively.

Examples 46 to 48

According to the same manner as that described in Examples 14 to 16 except for using a Y type oxotitanylphthalocyanine (CG2-2) as the electric charge generating material, single-layer type photosensitive materials for digital light source were produced, respectively.

Comparative Examples 7 to 9

According to the same manner as that described in Comparative Examples 1 to 3 except for using a Y type oxotitanylphthalocyanine (CG2-2) as the electric charge generating material, single-layer type photosensitive materials for digital light source were produced, respectively.

The photosensitive materials obtained in Examples 33 to 48 and Comparative Examples 7 to 9 were subjected to the above electrical characteristics test (I) and the electrical characteristics of the respective photosensitive materials were evaluated, respectively. The kind of the electric charge generating material, hole transferring material and electron transferring material used in the above respective Examples and Comparative Examples as well as test results of the electrical characteristics are shown in Table 7.

TABLE 7

| | CGM | HTM | ETM | $V_o$ | $V_r$ | $E_{1/2}$ |
|---|---|---|---|---|---|---|
| EX. 33 | CG2-2 | 12-1 | 2-1 | 698 | 91 | 0.61 |
| EX. 34 | CG2-2 | 12-8 | 2-1 | 700 | 110 | 0.63 |
| EX. 35 | CG2-2 | 11-9 | 2-1 | 697 | 89 | 0.64 |
| EX. 36 | CG2-2 | 12-17 | 2-1 | 697 | 92 | 0.65 |
| EX. 37 | CG2-2 | 11-17 | 2-1 | 701 | 91 | 0.63 |
| EX. 38 | CG2-2 | 12-1 | 3-1 | 699 | 90 | 0.66 |
| EX. 39 | CG2-2 | 12-8 | 3-1 | 700 | 108 | 0.63 |
| EX. 40 | CG2-2 | 11-9 | 3-1 | 700 | 91 | 0.67 |
| EX. 41 | CG2-2 | 12-17 | 3-1 | 702 | 89 | 0.65 |
| EX. 42 | CG2-2 | 11-17 | 3-1 | 703 | 90 | 0.61 |
| EX. 43 | GG2-2 | 12-1 | 3-2 | 703 | 88 | 0.62 |
| EX. 44 | CG2-2 | 12-8 | 3-2 | 697 | 111 | 0.63 |
| EX. 45 | CG2-2 | 11-9 | 3-2 | 689 | 93 | 0.62 |
| EX. 46 | CG2-2 | 12-1 | 4-1 | 693 | 90 | 0.60 |
| EX. 47 | CG2-2 | 12-8 | 4-1 | 695 | 105 | 0.61 |
| EX. 48 | CG2-2 | 11-9 | 4-1 | 700 | 90 | 0.62 |
| COMP. EX. 7 | CG2-2 | 6-1 | — | 699 | 161 | 1.09 |
| COMP. EX. 8 | CG2-2 | 6-2 | — | 700 | 159 | 1.10 |
| COMP. EX. 9 | CG2-2 | 6-3 | — | 701 | 157 | 1.13 |

(Single-layer type photosensitive material for analog light source)

Examples 49 to 53

According to the same manner as that described in Examples 1 to 5 except for using a perylene pigment represented by the formula (CG3-1):

(CG3-1)

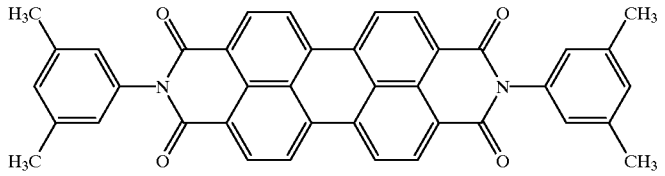

as the electric charge generating material, single-layer type photosensitive materials for analog light source were produced, respectively.

Examples 54 to 58

According to the same manner as that described in Examples 6 to 10 except for using a perylene pigment (CG3-1) as the electric charge generating material, single-layer type photosensitive materials for analog light source were produced, respectively.

Examples 59 to 61

According to the same manner as that described in Examples 11 to 13 except for using a perylene pigment (CG3-1) as the electric charge generating material, single-layer type photosensitive materials for analog light source were produced, respectively.

Examples 62 to 64

According to the same manner as that described in Examples 14 to 16 except for using a perylene pigment (CG3-1) as the electric charge generating material, single-layer type photosensitive materials for analog light source were produced, respectively.

Comparative Examples 10 to 12

According to the same manner as that described in Comparative Examples 1 to 3 except for using a perylene pigment (CG3-1) as the electric charge generating material, single-layer type photosensitive materials for analog light source were produced, respectively.

The photosensitive materials obtained in Examples 49 to 64 and Comparative Examples 10 to 12 were subjected to the following electrical characteristics test (II) and the electrical characteristics of the respective photosensitive materials were evaluated, respectively.

Electrical Characteristics Test (II)

According to the same manner as that described in the above electrical characteristics test (I) except for using white light (light intensity: 8 lux) from a halogen lamp as an exposure light source, the surface potential $V_0$ (V), residual potential $V_r$ (V) and half-life exposure $E_{1/2}$ (lux.second) were determined.

The kind of the electric charge generating material, hole transferring material and electron transferring material used in the above respective Examples and Comparative Examples as well as test results of the electrical characteristics are shown in Table 8.

TABLE 8

| | CGM | HTM | ETM | $V_o$ | $V_r$ | $E_{1/2}$ |
|---|---|---|---|---|---|---|
| EX. 49 | CG3-1 | 12-1 | 2-1 | 700 | 198 | 1.56 |
| EX. 50 | CG3-1 | 12-8 | 2-1 | 698 | 212 | 1.54 |
| EX. 51 | CG3-1 | 11-9 | 2-1 | 713 | 189 | 1.53 |
| EX. 52 | CG3-1 | 12-17 | 2-1 | 703 | 181 | 1.53 |
| EX. 53 | CG3-1 | 11-17 | 2-1 | 705 | 178 | 1.50 |
| EX. 54 | CG3-1 | 12-1 | 3-1 | 709 | 183 | 1.55 |
| EX. 55 | CG3-1 | 12-8 | 3-1 | 713 | 199 | 1.49 |
| EX. 56 | CG3-1 | 11-9 | 3-1 | 709 | 177 | 1.48 |
| EX. 57 | CG3-1 | 12-17 | 3-1 | 711 | 186 | 1.56 |
| EX. 58 | CG3-1 | 11-17 | 3-1 | 701 | 173 | 1.45 |
| EX. 59 | GG3-1 | 12-1 | 3-2 | 706 | 182 | 1.53 |
| EX. 60 | CG3-1 | 12-8 | 3-2 | 707 | 201 | 1.53 |
| EX. 61 | CG3-1 | 11-9 | 3-2 | 709 | 179 | 1.54 |
| EX. 62 | CG3-1 | 12-1 | 4-1 | 703 | 170 | 1.48 |
| EX. 63 | CG3-1 | 12-8 | 4-1 | 709 | 195 | 1.43 |
| EX. 64 | CG3-1 | 11-9 | 4-1 | 699 | 181 | 1.55 |
| COMP. EX. | CG3-1 | 6-1 | — | 705 | 252 | 1.82 |
| COMP. EX. | CG3-1 | 6-2 | — | 701 | 248 | 1.81 |
| COMP. EX. | CG3-1 | 6-3 | — | 711 | 250 | 1.83 |

Examples 65 to 69

According to the same manner as that described in Examples 49 to 53 except for using a bisazo pigment represented by the formula (CG4-1):

(CG4-1)

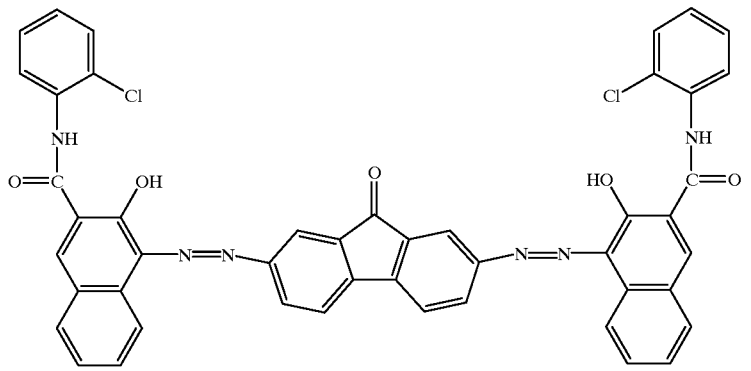

as the electric charge generating material, single-layer type photosensitive materials for analog light source were produced, respectively.

Examples 70 to 74

According to the same manner as that described in Examples 54 to 58 except for using a bisazo pigment (CG4-1) as the electric charge generating material, single-layer type photosensitive materials for analog light source were produced, respectively.

Examples 75 to 77

According to the same manner as that described in Examples 59 to 61 except for using a bisazo pigment (CG4-1) as the electric charge generating material, single-layer type photosensitive materials for analog light source were produced, respectively.

Examples 78 to 80

According to the same manner as that described in Examples 62 to 64 except for using a bisazo pigment (CG4-1) as the electric charge generating material, single-layer type photosensitive materials for analog light source were produced, respectively.

Comparative Examples 13 to 15

According to the same manner as that described in Comparative Examples 10 to 12 except for using a bisazo pigment (CG4-1) as the electric charge generating material, single-layer type photosensitive materials for analog light source were produced, respectively.

The photosensitive materials obtained in Examples 65 to 80 and Comparative Examples 13 to 15 were subjected to the above electrical characteristics test (II) and the electrical characteristics of the respective photosensitive materials were evaluated, respectively. The kind of the electric charge generating material, hole transferring material and electron transferring material used in the above respective Examples and Comparative Examples as well as test results of the electrical characteristics are shown in Table 9.

TABLE 9

| | CGM | HTM | ETM | $V_o$ | $V_r$ | $E_{1/2}$ |
|---|---|---|---|---|---|---|
| EX. 65 | CG4-1 | 12-1 | 2-1 | 709 | 151 | 1.32 |
| EX. 66 | CG4-1 | 12-8 | 2-1 | 711 | 179 | 1.33 |
| EX. 67 | CG4-1 | 11-9 | 2-1 | 703 | 150 | 1.32 |
| EX. 68 | CG4-1 | 12-17 | 2-1 | 701 | 149 | 1.32 |
| EX. 69 | CG4-1 | 11-17 | 2-1 | 693 | 147 | 1.34 |
| EX. 70 | CG4-1 | 12-1 | 3-1 | 705 | 139 | 1.29 |
| EX. 71 | CG4-1 | 12-8 | 3-1 | 702 | 172 | 1.33 |
| EX. 72 | CG4-1 | 11-9 | 3-1 | 713 | 148 | 1.32 |
| EX. 73 | CG4-1 | 12-17 | 3-1 | 707 | 140 | 1.29 |
| EX. 74 | CG4-1 | 11-17 | 3-1 | 701 | 139 | 1.28 |
| EX. 75 | GG4-1 | 12-1 | 3-2 | 709 | 142 | 1.30 |
| EX. 76 | CG4-1 | 12-8 | 3-2 | 714 | 165 | 1.29 |
| EX. 77 | CG4-1 | 11-9 | 3-2 | 708 | 139 | 1.28 |
| EX. 78 | CG4-1 | 12-1 | 4-1 | 711 | 148 | 1.32 |
| EX. 79 | CG4-1 | 12-8 | 4-1 | 695 | 165 | 1.31 |
| EX. 80 | CG4-1 | 11-9 | 4-1 | 704 | 149 | 1.32 |
| COMP. EX. | CG4-1 | 6-1 | — | 701 | 221 | 1.75 |
| COMP. EX. | CG4-1 | 6-2 | — | 705 | 219 | 1.74 |
| COMP. EX. | CG4-1 | 6-3 | — | 712 | 220 | 1.75 |

Examples 81 to 85

According to the same manner as that described in Examples 49 to 53 except for using a bisazo pigment represented by the formula (CG4-2):

(CG4-2)

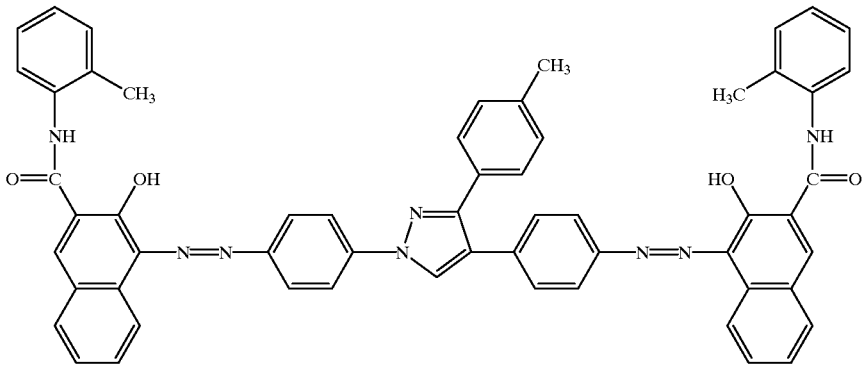

as the electric charge generating material, single-layer type photosensitive materials for analog light source were produced, respectively.

Examples 86 to 90

According to the same manner as that described in Examples 54 to 58 except for using a bisazo pigment (CG4-2) as the electric charge generating material, single-layer type photosensitive materials for analog light source were produced, respectively.

Examples 91 to 93

According to the same manner as that described in Examples 59 to 61 except for using a bisazo pigment (CG4-2) as the electric charge generating material, single-layer type photosensitive materials for analog light source were produced, respectively.

Examples 94 to 96

According to the same manner as that described in Examples 62 to 64 except for using a bisazo pigment (CG4-2) as the electric charge generating material, single-layer type photosensitive materials for analog light source were produced, respectively.

Comparative Examples 16 to 18

According to the same manner as that described in Comparative Examples 10 to 12 except for using a bisazo pigment (CG4-2) as the electric charge generating material, single-layer type photosensitive materials for analog light source were produced, respectively.

The photosensitive materials obtained in Examples 81 to 96 and Comparative Examples 16 to 18 were subjected to the above electrical characteristics test (II) and the electrical characteristics of the respective photosensitive materials were evaluated, respectively. The kind of the electric charge generating material, hole transferring material and electron transferring material used in the above respective Examples and Comparative Examples as well as test results of the electrical characteristics are shown in Table 10.

TABLE 10

| | CGM | HTM | ETM | $V_o$ | $V_r$ | $E_{1/2}$ |
|---|---|---|---|---|---|---|
| EX. 81 | CG4-2 | 12-1 | 2-1 | 703 | 173 | 1.48 |
| EX. 82 | CG4-2 | 12-8 | 2-1 | 705 | 189 | 1.47 |
| EX. 83 | CG4-2 | 11-9 | 2-1 | 700 | 175 | 1.49 |
| EX. 84 | CG4-2 | 12-17 | 2-1 | 701 | 168 | 1.47 |
| EX. 85 | CG4-2 | 11-17 | 2-1 | 707 | 175 | 1.49 |
| EX. 86 | CG4-2 | 12-1 | 3-1 | 709 | 162 | 1.41 |
| EX. 87 | CG4-2 | 12-8 | 3-1 | 711 | 170 | 1.33 |
| EX. 88 | CG4-2 | 11-9 | 3-1 | 708 | 155 | 1.34 |
| EX. 89 | CG4-2 | 12-17 | 3-1 | 695 | 164 | 1.45 |
| EX. 90 | CG4-2 | 11-17 | 3-1 | 709 | 159 | 1.41 |
| EX. 91 | CG4-2 | 12-1 | 3-2 | 693 | 142 | 1.29 |
| EX. 92 | CG4-2 | 12-8 | 3-2 | 699 | 169 | 1.30 |
| EX. 93 | CG4-2 | 11-9 | 3-2 | 712 | 158 | 1.35 |
| EX. 94 | CG4-2 | 12-1 | 4-1 | 713 | 159 | 1.36 |
| EX. 95 | CG4-2 | 12-8 | 4-1 | 703 | 169 | 1.30 |
| EX. 96 | CG4-2 | 11-9 | 4-1 | 705 | 148 | 1.31 |
| COMP. EX. | CGA-2 | 6-1 | — | 709 | 232 | 1.79 |
| COMP. EX. | CG4-2 | 6-2 | — | 708 | 241 | 1.82 |
| COMP. EX. | CG4-2 | 6-3 | — | 700 | 239 | 1.80 |

Examples 97 to 101

According to the same manner as that described in Examples 49 to 53 except for using a bisazo pigment represented by the formula (CG4-3):

(CG4-3)

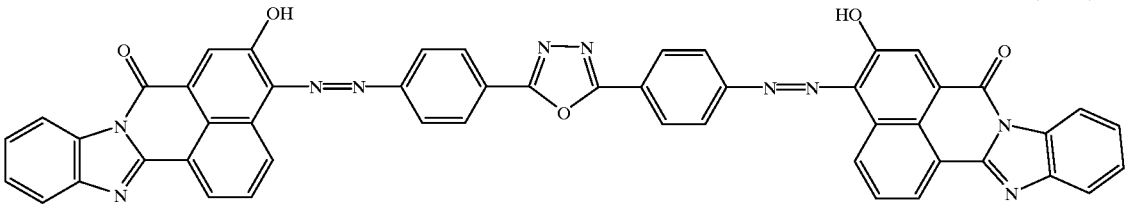

as the electric charge generating material, single-layer type photosensitive materials for analog light source were produced, respectively.

Examples 102 to 106

According to the same manner as that described in Examples 54 to 58 except for using a bisazo pigment (CG4-3) as the electric charge generating material, single-layer type photosensitive materials for analog light source were produced, respectively.

Examples 107 to 109

According to the same manner as that described in Examples 59 to 61 except for using a bisazo pigment (CG4-3) as the electric charge generating material, single-layer type photosensitive materials for analog light source were produced, respectively.

Examples 110 to 112

According to the same manner as that described in Examples 62 to 64 except for using a bisazo pigment (CG4-3) as the electric charge generating material, single-layer type photosensitive materials for analog light source were produced, respectively.

Comparative Examples 19 to 21

According to the same manner as that described in Comparative Examples 10 to 21 except for using a bisazo pigment (CG4-3) as the electric charge generating material, single-layer type photosensitive materials for analog light source were produced, respectively.

The photosensitive materials obtained in Examples 97 to 112 and Comparative Examples 19 to 21 were subjected to the above electrical characteristics test (II) and the electrical characteristics of the respective photosensitive materials were evaluated, respectively. The kind of the electric charge generating material, hole transferring material and electron transferring material used in the above respective Examples and Comparative Examples as well as test results of the electrical characteristic& are shown in Table 11.

TABLE 11

| | CGM | HTM | ETM | $V_o$ | $V_r$ | $E_{1/2}$ |
|---|---|---|---|---|---|---|
| EX. 97 | CG4-3 | 12-1 | 2-1 | 702 | 185 | 1.51 |
| EX. 98 | CG4-3 | 12-8 | 2-1 | 713 | 201 | 1.49 |
| EX. 99 | CG4-3 | 11-9 | 2-1 | 709 | 179 | 1.48 |
| EX. 100 | CG4-3 | 12-17 | 2-1 | 707 | 188 | 1.51 |
| EX. 101 | CG4-3 | 11-17 | 2-1 | 700 | 181 | 1.49 |
| EX. 102 | CG4-3 | 12-1 | 3-1 | 701 | 189 | 1.52 |
| EX. 103 | CG4-3 | 12-8 | 3-1 | 703 | 219 | 1.55 |
| EX. 104 | CG4-3 | 11-9 | 3-1 | 712 | 189 | 1.54 |

TABLE 11-continued

| | CGM | HTM | ETM | $V_o$ | $V_r$ | $E_{1/2}$ |
|---|---|---|---|---|---|---|
| EX. 105 | CG4-3 | 12-17 | 3-1 | 715 | 183 | 1.49 |
| EX. 106 | CG4-3 | 11-17 | 3-1 | 698 | 181 | 1.48 |
| EX. 107 | CG4-3 | 12-1 | 3-2 | 699 | 172 | 1.45 |
| EX. 108 | CG4-3 | 12-8 | 3-2 | 712 | 199 | 1.48 |
| EX. 109 | CG4-3 | 11-9 | 3-2 | 715 | 183 | 1.49 |
| EX. 110 | CG4-3 | 12-1 | 4-1 | 708 | 191 | 1.53 |
| EX. 111 | CG4-3 | 12-8 | 4-1 | 707 | 200 | 1.53 |
| EX. 112 | CG4-3 | 11-9 | 4-1 | 709 | 188 | 1.52 |
| COMP. EX. | CG4-3 | 6-1 | — | 701 | 241 | 1.79 |
| COMP. EX. | CG4-3 | 6-2 | — | 705 | 242 | 1.73 |
| COMP. EX. | CG4-3 | 6-3 | — | 699 | 255 | 1.81 |

As is apparent from Tables 5 to 11, regarding the electrophotosensitive materials using the stilbene derivative represented by the general formula (1) as the hole transferring material of Examples 1 to 112, the residual potential $V_r$ is largely lowered in comparison with those of the Comparative Examples corresponding to the respective Examples. With respect to the half-life exposure $E_{1/2}$, the value of the Examples is smaller than that of the corresponding Comparative Examples. Consequently, it is found that the electrophotosensitive materials of Examples 1 to 112 have excellent sensitivity.

What is claimed is:

1. An electrophotosensitive material comprising a conductive substrate and a single photosensitive layer containing a hole transferring material and an electron transferring material, which is provided on the conductive substrate, wherein the hole transferring material is a stilbene derivative represented by the general formula (1):

(1)

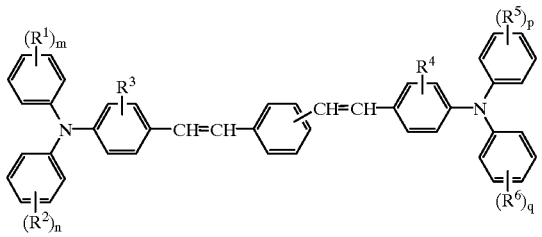

(wherein $R^1$, $R^2$, $R^5$ and $R^6$ are the same or different and represent an alkyl group, an alkoxy group, an aryl group, an aralkyl group or a halogen atom; m, n, p and q are the same or different and represent an integer of 0 to 3, with the proviso that m and n represent a different integer when substituents represented by $R^1$ and $R^2$ are the same and that p and q represent a different integer when substituents represented by $R^5$ and $R^6$ are the same; and $R^3$ and $R^4$ are the same or different and represent a hydrogen atom or an alkyl group).

2. The electrophotosensitive material according to claim 1, wherein the hole transferring material is represented by the general formula (11) or (12):

(11)

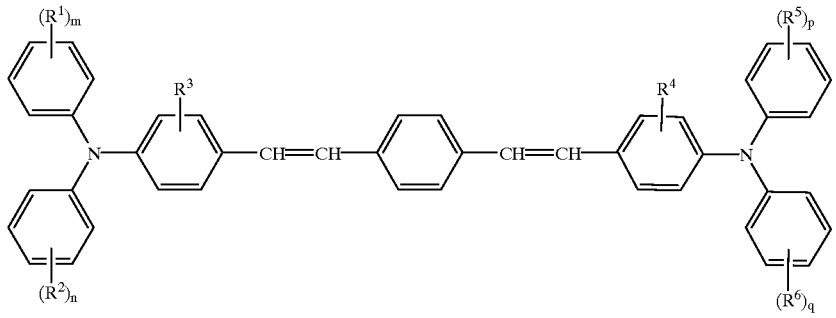

(12)

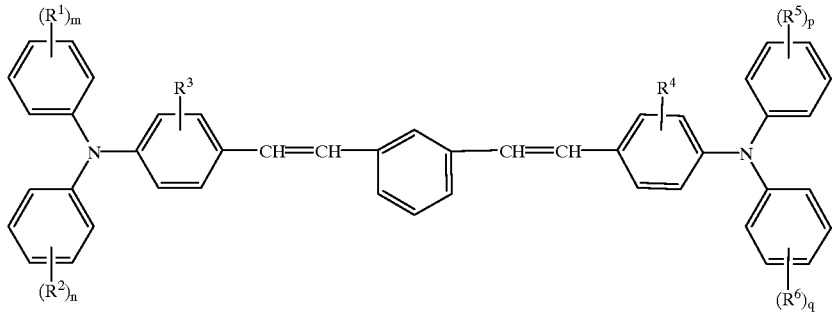

(wherein $R^1$ to $R^6$ and m to q are as defined above).

3. The electrophotosensitive material according to claim 1, wherein the electron transferring material is at least one selected from the group consisting of diphenoquinone derivative represented by the general formula (2):

(2)

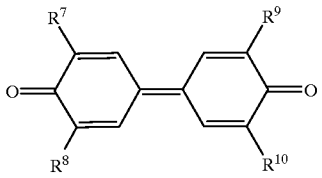

[wherein $R^7$, $R^8$, $R^9$ and $R^{10}$ are the same or different and represent a hydrogen atom, an alkyl group, an alkoxy group, an aryl group, an aralkyl group, a cycloalkyl group or an amino group, with the proviso that at least two substituents of $R^7$, $R^8$, $R^9$ and $R^{10}$ are the same and are groups other than a hydrogen atom], naphthoquinone derivative represented by the general formula (3):

(3)

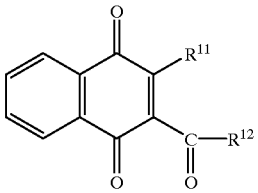

[wherein $R^{11}$ represents an alkyl group which may have a substituent, or an aryl group which may have a substituent; and $R^{12}$ represents an alkyl group which may have a substituent, an aryl group which may have a substituent, or a group:

$$—O—R^{12a}$$

(in which $R^{12a}$ represents an alkyl group which may have a substituent, or an aryl group which may have a substituent)], diazanaphtho[2,3-b]fluorene derivative represented by the general formula (4):

(4)

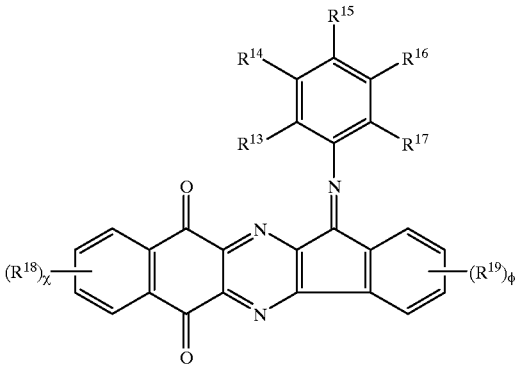

[wherein $R^{13}$, $R^{14}$, $R^{15}$, $R^{16}$, $R^{17}$, $R^{18}$ and $R^{19}$ are the same or different and represent an alkyl group, an aryl group, an aralkyl group, an alkoxy group, a halogen atom or a halogenated alkyl group; and $\chi$ and $\phi$ are the same or different and represent an integer of 0 to 4] and diazanaphtho[2,3-b] fluorene derivative represented by the general formula (5):

(5)

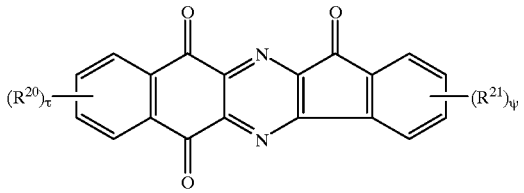

[wherein $R^{20}$ and $R^{21}$ are the same or different and represent an alkyl group, an aryl group, an alkoxy group, a halogen atom or a halogenated alkyl group; and $\tau$ and $\psi$ are the same or different and represent an integer of 0 to 4].

* * * * *